US005389506A

United States Patent [19]

Sutton

[11] Patent Number: 5,389,506

[45] Date of Patent: Feb. 14, 1995

[54] ELEMENTS AND PROCESSES FOR PRODUCING SUPERIOR PHOTOGRAPHIC RECORDS

[75] Inventor: James E. Sutton, Rochester, N.Y.

[73] Assignee: Eastman Kodak Company, Rochester, N.Y.

[21] Appl. No.: 112,006

[22] Filed: Aug. 25, 1993

Related U.S. Application Data

[63] Continuation-in-part of Ser. No. 905,597, Jul. 26, 1992, Pat. No. 5,314,794.

[51] Int. Cl.[6] ..... G03C 1/08

[52] U.S. Cl. ..... 430/509; 430/506; 430/375; 430/376; 430/382; 430/383; 430/434; 430/301

[58] Field of Search ..... 430/506, 509, 375, 376, 430/382, 383, 434, 301

[56] References Cited

U.S. PATENT DOCUMENTS

| | | | |
|---|---|---|---|
| 3,726,681 | 4/1973 | Pankow et al. | 430/506 |
| 3,846,135 | 11/1974 | Hellmig et al. | 430/496 |
| 4,184,876 | 1/1980 | Eeles et al. | 430/505 |
| 4,267,264 | 5/1981 | Lohmann et al. | 430/506 |
| 4,439,520 | 3/1984 | Kofron et al. | 430/434 |
| 4,777,122 | 10/1988 | Beltramini | 430/506 |
| 4,818,663 | 4/1989 | Powers et al. | 430/509 |
| 4,943,517 | 7/1990 | Powers et al. | 430/301 |
| 5,108,881 | 4/1992 | Dickerson et al. | 430/509 |

FOREIGN PATENT DOCUMENTS 1458370 12/1976 United Kingdom .

OTHER PUBLICATIONS

Research Disclosure, Item 308119, Dec. 1989, Kenneth Mason Publications, Ltd., Disclosed Anonymously.

*Primary Examiner*—Thomas R. Neville
*Attorney, Agent, or Firm*—Carl O. Thomas

[57] ABSTRACT

A process of producing a viewable photographic image is disclosed wherein an imagewise exposed photographic element containing at least two silver halide emulsion layers capable of recording within the same region of the spectrum and having differing threshold sensitivities produces during photographic processing spectrally distinguishable images. Separate image records are obtained from the emulsion layers, and the image record corresponding to the photographically superior image is preferentially employed in producing a viewable image.

30 Claims, No Drawings

ELEMENTS AND PROCESSES FOR PRODUCING SUPERIOR PHOTOGRAPHIC RECORDS

This is a continuation-in-part of Ser. No. 905,597, filed Jul. 26, 1992, Pat. No. 5,314,794.

FIELD OF THE INVENTION

The invention relates to silver halide photographic elements and to processes of producing viewable images employing these photographic elements.

BACKGROUND

In classical black-and-white photography a photographic element containing a silver halide emulsion layer coated on a transparent film support is imagewise exposed to light. This produces a latent image within the emulsion layer. The film is then photographically processed to transform the latent image into a silver image that is a negative image of the subject photographed. The resulting processed photographic element, commonly referred to as a negative, is placed between a uniform exposure light source and a second photographic element, commonly referred to as a photographic paper, containing a silver halide emulsion layer coated on a white paper support. Exposure of the emulsion layer of the photographic paper through the negative produces a latent image in the photographic paper that is a positive image of the subject originally photographed. Photographic processing of the photographic paper produces a positive silver image. The image bearing photographic paper is commonly referred to as a print.

In a well known, but much less common, variant of classical black-and-white photography a direct positive emulsion can be employed, so named because the first image produced on processing is a positive silver image, obviating any necessity of printing to obtain a viewable positive image. Another well known variation, commonly referred to as instant photography, involves imagewise transfer of silver ion to a physical development site in a receiver to produce a viewable transferred silver image.

In classical color photography the photographic film contains three superimposed silver halide emulsion layer units, one for forming a latent image corresponding to blue light (i.e., blue) exposure, one for forming a latent image corresponding to green exposure and one for forming a latent image corresponding to red exposure. During photographic processing dye images that are complementary subtractive primaries-that is, yellow, magenta and cyan dye images are formed in the blue, green and red recording emulsion layers, respectively. This produces negative dye images (i.e., blue, green and red subject features appear yellow, magenta and cyan, respectively). Exposure of color paper through the color negative followed by photographic processing produces a positive color print.

In one common variation of classical color photography reversal processing is undertaken to produce a positive dye image in the color film (commonly referred to as a slide, the image typically being viewed by projection). In another common variation, referred to as color image transfer or instant photography, image dyes are transferred to a receiver for viewing.

In each of the classical forms of photography noted above the final image is intended to be viewed by the human eye. Thus, the conformation of the viewed image to the subject image, absent intended aesthetic departures, is the criterion of photographic success.

With the emergence of computer controlled data processing capabilities, interest has developed in extracting the information contained in an imagewise exposed photographic element instead of proceeding directly to a viewable image. It is now common practice to extract the information contained in both black-and-white and color images by scanning. The most common approach to scanning a black-and-white negative is to record point-by-point or line-by-line the transmission of a near infrared beam, relying on developed silver to modulate the beam. In color photography blue, green and red scanning beams are modulated by the yellow, magenta and cyan image dyes. In a variant color scanning approach the blue, green and red scanning beams are combined into a single white scanning beam modulated by the image dyes that is read through red, green and blue filters to create three separate records. The records produced by image dye modulation can then be read into any convenient memory medium (e.g., an optical disk). The advantage of reading an image into memory is that the information is now in a form that is free of the classical restraints of photographic embodiments. For example, age degradation of the photographic image can be for all practical purposes eliminated. Systematic manipulation (e.g., image reversal, hue alteration, etc.) of the image information that would be cumbersome or impossible to achieve in a controlled and reversible manner in a photographic element are readily achieved. The stored information can be retrieved from memory to modulate light exposures necessary to recreate the image as a photographic negative, slide or print at will. Alternatively, the image can be viewed as a video display or printed by a variety of techniques beyond the bounds of classical photography-e.g., xerography, ink jet printing, dye diffusion printing, etc.

Hunt U.K. 1,458,370 illustrates a color photographic element constructed to have three separate color records extracted by scanning. Hunt employs a classical color film modified by the substitution of a panchromatic sensitized silver halide emulsion layer for the green recording emulsion layer. Following imagewise exposure and processing three separate records are present in the film, a yellow dye image recording blue exposure, a cyan dye image recording red exposure and a magenta dye image recording exposure throughout the visible Spectrum. These three dye images are then used to derive blue, green and red exposure records, but the photographic element itself is not properly balanced to be used as a color negative is classically used for photographic print formation.

One of the common techniques for improving the speed-granularity relationship of an image produced in a silver halide photographic element is to provide multiple (usually two or three) superimposed silver halide emulsion layers differing in speed (i.e., differing in their threshold sensitivities). By coating the fastest of the emulsion layers to receive imagewise exposing radiation first, the effective speed of the fastest layer is increased without increasing its granularity. Hellmig U.S. Pat. No. 3,846,135 discloses fast over slow emulsion layer arrangements in black-and-white photographic elements while Eeles et al U.S. Pat. No. 4,184,876 and Kofron et al U.S. Pat. No. 4,439,520 disclose similar arrangements in color photographic elements, the latter also providing a background explanation of speed-granularity relationships.

SUMMARY OF THE INVENTION

One of the significant limitations of silver halide photography prior to the present invention has been the requirement that all silver halide emulsion layers that record exposures of the same region of the spectrum also produce images that are spectrally indistinguishable. This is essential in reproducing an image for viewing with the procedures of classical silver halide photography, since otherwise the eye would see the images as spectrally distorted.

It is the recognition of this invention that superior imaging capabilities can be attained by forming spectrally distinguishable images in silver halide emulsion layers of differing threshold sensitivity levels used to record exposures within the same region of the spectrum. By producing at least two spectrally distinguishable images it is possible to form a photographically superior record in a selected exposure range within one of the emulsion layers and to use this record preferentially in forming a viewable image.

In one aspect the invention is directed to a photographic element comprised of a support and at least two silver halide emulsion layers differing in threshold sensitivities for recording exposures within the same region of the spectrum, wherein one of the emulsion layers is capable of recording an image that exhibits a higher signal to noise ratio than at least one other of said emulsion layers in at least one exposure range above their threshold sensitivities and at least two of the emulsion layers differing in threshold sensitivities each containing a different dye image providing material, each of the different dye image providing materials being chosen so that when any two of the image dyes produced by the different dye image providing materials are compared, at least 25 percent of the half peak absorption band width of each image dye lies in a spectral region unoccupied by the half peak absorption band width of the compared image dye.

In another aspect, the invention is directed to a process of producing a viewable photographic image comprising photographically processing an imagewise exposed photographic element containing at least two silver halide emulsion layers capable of recording within the same region of the spectrum and having differing threshold sensitivities to produce a photographic image and employing the photographic image to produce a viewable image, wherein different dye images are produced during processing following imagewise exposure in said emulsion layers, each dye image when compared to any other dye image has a half peak absorption band width at least 25 percent of which lies in a spectral region unoccupied by the half peak absorption band width of the compared dye image, a first of said two emulsion layers requiring a higher exposure to reach its threshold sensitivity exhibiting a higher signal to noise ratio dye image in at least one exposure range above its threshold sensitivity after processing than a second of said two emulsion layers, and the dye image of said first emulsion layer is preferentially employed in producing portions of the viewable image indicative of exposures above its threshold sensitivity within an exposure range in which it exhibits a higher signal to noise ratio.

DESCRIPTION OF PREFERRED EMBODIMENTS

The present invention contemplates obtaining a superior viewable image using a photographic element containing at least two silver halide emulsion layers each capable of recording an imagewise exposure within the same region of the spectrum.

The basic features of the invention can be appreciated by reference to a photographic element according to the invention satisfying Structure I:

| Structure I |
|---|
| First Silver Halide Emulsion Layer |
| Second Silver Halide Emulsion Layer |
| Photographic Support |

The first and second silver halide emulsion layers can take any convenient conventional form capable of forming a latent image in response to imagewise exposure within the same region of the spectrum. In the simplest possible form the first and second emulsion layers contain grains of the same silver halide or combination of silver halides and rely on native sensitivity to the same region of the spectrum. Instead of relying on native spectral sensitivity, the emulsion layers can contain one or more spectral sensitizing dyes extending sensitivity to any desired region of the spectrum and/or enhancing sensitivity within the region of native sensitivity. To the extent that spectral sensitizing dye rather than native silver halide absorption of exposing radiation is relied upon for latent image formation during exposure, it follows that the emulsion layers can be formed of any combination of silver halides. Further, so long as the first and second emulsion layers are capable of recording exposures to the same spectral region, it is immaterial whether the same silver halides and/or the same spectral sensitizing dyes are selected for each emulsion layer.

Examples of first and second emulsion layers that are capable of recording exposures to the same spectral region are first and second emulsion layers that are both capable of forming latent images upon exposure to blue (400 to 500 nm) light, both capable of forming latent images upon exposure to green (500 to 600 nm) light, both capable of forming latent images upon exposure to red (600 to 700 nm) light, both capable of forming latent images upon exposure to blue and green light (i.e., both emulsion layers are orthochromatically sensitized), or both capable of forming latent images upon exposure to blue, green and red light (i.e., both emulsion layers are panchromatically sensitized). The spectral sensitivities of the first and second emulsion layers preferably exhibit peak sensitivities that differ by less than 50 nm and, optimally, differ by less than 25 nm.

The first and second silver halide emulsion layers must have significantly different threshold sensitivities. The threshold sensitivity of an emulsion layer is the exposure level at which a density is imparted following processing that differs significantly from the density level observed in the absence of exposure. For negative-working emulsions processed to for negative images threshold sensitivity is located at the first exposure increment that produces a measurable density higher than the minimum density ($D_{min}$). For negative-working emulsions that are processed to produce positive images (i.e., reversal processed) and for direct positive emulsions threshold sensitivity is located at the first exposure increment that produces a measurable density below maximum density ($D_{max}$).

The difference in the threshold sensitivities of the first and second emulsion layers are for practical purposes the same as the differences in their speeds, and the two terms are therefore hereinafter employed interchangeably. The speed difference of the two emulsion layers can be conveniently measured as the difference in their speeds when separately coated and identically exposed and processed. The speed of a negative-working emulsion layer when processed to produce a negative image is usually defined as the exposure required to produce a selected density near the toe of the characteristic curve, typically at or near a density of 0.1 above $D_{min}$ (fog). The speed of a reversal processed negative-working emulsion or a direct positive emulsion is usually defined as the exposure required to produce a selected density of at least 0.2 below $D_{max}$. The selected density is often a mid-scale density:

$$[(D_{max}-D_{min})\div 2]+D_{min}.$$

It is generally preferred that the first and second layers exhibit a threshold sensitivity difference of at least one half stop (0.15 log E, where E in this and all subsequent occurrences represents exposure in lux-seconds) and preferably at least one stop (0.30 log E).

The maximum tolerable threshold sensitivity difference between the first and second emulsion layers is dependent on the exposure latitude (the difference between the exposure at threshold sensitivity and the exposure at or approaching maximum density) of the higher speed of the emulsion layers. As is generally understood in the art, the two emulsion layers must together produce a composite characteristic curve that exhibits a continuous increase in density as a function of increasing exposure. For this effect to be realized the threshold sensitivity of the next slower emulsion layer must occur at an exposure level no higher than that required to reach the shoulder of the characteristic curve of the fastest emulsion layer. Dickerson et al U.S. Pat. No. 5,108,881, the disclosure of which is here incorporated by reference, illustrates combinations of emulsion layers which, apart from the absence of an incorporated image dye providing compound, are capable of satisfying the imaging requirements of the invention. The higher speed of the emulsion layers exhibits a threshold speed that is up to 2.0 log E (preferably up to 1.0 log E) faster than that of the remaining emulsion layer. A preferred difference in threshold sensitivity levels for the first and second emulsion layers for commonly encountered color and black-and-white imaging applications is in the range of from one-half (0.15 log E) to two stops (0.60 log E).

To achieve a difference in threshold speeds of at least one half stop, it is necessary that the two emulsion layers be nonidentically constructed. The almost universally employed technique of increasing photographic speed is to employ chemical sensitization. Thus, it is possible to increase the threshold sensitivity of one emulsion layer with respect to the other by chemically sensitizing one emulsion layer and not the other. Another technique for increasing the threshold sensitivity of one emulsion layer in relation to another is to incorporate grains of a halide that is more efficient (e.g., silver bromodiodide as opposed to silver bromide or silver chloride) in the faster emulsion layer. Still another technique is to increase the mean equivalent circular diameter (ECD) of the grains in one emulsion layer to increase the speed of one emulsion layer as opposed to another.

To obtain the most favorable signal-to-noise relationship (the inverse of the standard deviation of apparent input exposure reported in the Examples below) it is preferred that both the first and second emulsion layers be substantially optimally sensitized with the differences in the threshold speeds of the emulsion layers being attributable to differences in the mean ECD's of the grains of the emulsion layers. By achieving the maximum speed from each emulsion layer with the minimum average grain size (ECD), the highest attainable signal to noise relationship can be realized.

A feature that distinguishes the photographic elements of Structure I from the prior art is that the first and second emulsion layers, though relied upon to record imagewise exposures in the same region of the spectrum, produce spectrally distinguishable images. In the simplest contemplated form each emulsion layer produces on processing a different dye image—that is, the absorptions of the dyes forming the separate images in the first and second emulsion layers are noncoextensive. For example, if one of the dye images exhibits peak absorption in the blue, green, red or near infrared (700 to 1500 nm) portion of the spectrum, the remaining dye image preferably exhibits peak absorption in any convenient remaining region of the spectrum. Conventional photographic imaging dyes have relatively narrow absorption profiles, with half maximum absorption widths (hereinafter also referred to as half-peak absorption bands) typically well below 125 nm. It is preferred that the dye images in the first and second emulsion layers have non-overlapping half peak absorption bands. That is, preferably the half peak absorption band width of each image dye occupies a portion of the spectrum that is unoccupied by any other image dye contained in the photographic element after processing. Nevertheless, it is possible to discriminate between different image dyes even if some overlap of the half peak band widths occurs. Adequate image discrimination can be realized when each image dye has a half peak absorption band width at least 75 percent of which lies in a spectral region occupied by the half peak absorption band width of any other single image dye present after processing. That is, each dye image when compared to any other dye image has a half peak absorption band width at least 25 percent of which lies in a spectral region unoccupied by the half peak absorption band width of the compared dye image. It is possible to obtain by scanning and known resolution techniques a dye image having a half peak absorption band width that lies entirely within spectral regions occupied by the half peak absorption band widths of other dye images; however, the spectral overlap of the half peak absorption band width with any other single dye image should not exceed 75 percent. The 25 percent offset in the half peak absorption band width compared to any other individual dye image has been chosen to take the practical disadvantages of resolving unduly spectrally overlapping dye images into account using scanning techniques currently in common use. With further improvements in scanning capabilities it is contemplated that even larger spectral overlaps in image dyes can be accommodated. However, different image dyes selected for visually imperceptible hue differences on viewing, as are currently employed in classical color photographic elements, are too highly overlapping in their half peak absorption band widths to be useful in the practice of the invention.

When Structure I is imagewise exposed and conventionally photographically processed, two spectrally distinguishable dye images can be produced, one in the first emulsion layer and another in the second emulsion layer. By scanning Structure I after processing first with a light beam having wavelengths absorbed primarily by one of the dye images and recording the modulation of the light beam and then repeating the scanning step with a second light beam having wavelengths absorbed primarily by the remaining of the dye images, two separate image records can be obtained, corresponding to the images present in each of the first and second emulsion layers. Alternatively, the two light beams can be combined to allow a single scan of Structure I. In this instance the beam after modulation by Structure I is split with each half being passed through a filter selected to transmit only the portion of the beam that is modulated primarily by one of the dye images.

The information contained in the modulated beams can be captured to form two separate records of exposure of Structure I. In contrast to classical photography, which produces a single image that is an unresolvable composite of the imaging contributions of two or more emulsion layers sensitized to the same region of the spectrum, scanning Structure I allows the imaging contribution of each of the first and second emulsion layers to be separately captured. Although the threshold sensitivities of the first and second emulsion layers differ, the requirement of continuous increase in overall image density with increasing exposure dictates that, as a practical necessity, within at least one exposure range the first and second emulsion layers will both be providing image information. With two independent records of exposure covering a common imaging exposure range available it is now possible to employ preferentially the photographically superior image record for reproducing a viewable image. For example, assuming the difference in the threshold sensitivities of the first and second emulsion layers has been generated by employing a larger average ECD grain structure in one emulsion layer to increase speed and that the photographic enhancement of interest is to increase the ratio of signal to noise, in the exposure range in which two useful photographic records are available a better signal to noise ratio can be obtained by giving preference to the information provided by the lower average grain ECD emulsion—i.e., the emulsion layer exhibiting the lower granularity. If on the other hand, the object is to increase the sharpness of the image, then given a choice of image records provided by the two emulsion layers, within the exposure range in which two exposure records are available the record that is selected for producing a viewable image is that provided by the emulsion layer nearest the source of exposing radiation (and hence the layer that receives the most highly specular exposing radiation).

To produce a viewable image the two exposure records are combined to provide a superior composite record. At each image pixel to be created one or two image records are available for selection. If the pixel was exposed below the imaging threshold of both emulsion layers, either a maximum or a minimum imaging signal is provided, depending on the medium in which the image is being created and on whether a positive or negative image is being created. In the exposure range that is above the sensitivity threshold of one emulsion layer but below the sensitivity threshold of the remaining emulsion layer only one image record is available. Above the imaging threshold of the remaining emulsion layer two image records are created. The superior of the two records can be chosen exclusively for image generation or the two image records can be combined with the superior image record being given preferential weighting in their combination. The result is a viewable image that is photographically superior to that which would have been created had the imaging information come from a single source.

The discussion above of producing a superior image employing Structure I is recognized to present only one of many different forms of the invention. The scope of the invention and its further advantages can be better appreciated by reference to the description of preferred features and embodiments described above, particularly as they are contrasted with comparable conventional photographic elements and processes.

The emulsion layers of differing threshold sensitivities for recording exposures within the same region of the spectrum can be formed of conventional silver halide emulsions or blends of silver halide emulsions. Preferred emulsions are negative-working emulsions and particularly negative-working silver bromoiodide emulsions. The dye image requirement is preferably satisfied by incorporating in each emulsion layer a different dye-forming coupler. However, the invention is generally applicable to both positive or negative-working silver halide emulsions and to the full range of conventional approaches for forming dye images. *Research Disclosure,* Item 308119, published December 1989, (all cited sections of which are incorporated by reference) in Section I provides a summary of conventional emulsion grain features, in Section IX provides a summary of vehicles and vehicle extenders found in emulsion layers and other processing solution permeable layers, in Section II describes chemical sensitization, in Section III describes spectral sensitization, and in Section VII describes a wide selection of conventional dye image providing materials. *Research Disclosure* is published by Kenneth Mason Publications, Ltd., Emsworth, Hampshire P010 7DD, England. The photographic support in Structure I can take the form of any conventional transparent or reflective support. The inclusion in Structure I of other conventional photographic element features, such as one or more of the antifoggants and stabilizers summarized in Section VI, the hardeners summarized in Section X, the plasticizer and lubricants summarized in Section XII, the antistatic layers summarized in Section XIII and the matting agents summarized in Section XVI, conform to the routine practices of the art and require no detailed description.

The first step of the process of the invention is to photographically process Structure I after it has been imagewise exposed to produce separate dye images in the first and second emulsion layers. Any convenient conventional color processing employed in silver halide photography can be undertaken. Conventional photographic processing of color photographic elements particularly suited to the practice of this invention includes those summarized in Item 308119, cited above, Section XIX, particularly the color negative processing of subsection F. There is little, if any, incentive to complicate processing with image reversal, since image reversal can be easily accomplished in a computer after the image information has been extracted from the photographic element. A typical sequence of steps includes development to produce the dye images, stopping development, fixing to remove undeveloped silver halide, and bleaching of developed silver. Usually washing is interposed between successive processing steps.

Fixing can be omitted where the photographic element is protected from unwanted post-development printout (radiation induced reduction of silver halide to silver) prior to or during scanning. If the photographic element is photographically processed, scanned under conditions that avoid printout and then discarded, processing can be simplified by omitting fixing. In this regard it should be pointed out that it is specifically recognized that the photographic elements can be scanned in a spectral region offset from their spectral sensitivity, since, contrary to the requirements of classical color photography, the spectral region of peak absorption by the imaging dye can be selected entirely independently of the spectral sensitivity of the emulsion layers being processed. For example, whereas conventionally maximum image dye absorption of a green sensitized silver halide emulsion layer is also in the green (i.e., the dye is typically a magenta dye), in the practice of the invention the image dye can exhibit peak absorption in any desired region of the spectrum ranging from the near ultraviolet to the near infrared. If the peak absorptions of the image dyes in neither of the two emulsion layers is within the spectral regions of emulsion sensitivity, scanning can be readily achieved without risking printout when the fixing step is omitted.

Conventional scanning techniques satisfying the requirements described above can be employed and require no detailed description. It is possible to scan successively the photographic element within each of the wavelength ranges discussed above or to combine in one beam the different wavelengths and to resolve the combined beam into separate image density records by passing different portions of the beam through separate filters which allow transmission within only the spectral region corresponding to the image density record sought to be formed. A simple technique for scanning is to scan the photographically processed Structure I point-by-point along a series of laterally offset parallel scan paths. When the photographic support is transparent, as is preferred, the intensity of light passing through the photographic element at a scanning point is noted by a sensor which converts radiation received into an electrical signal. Alternatively, the photographic support can be reflective and the sensed signal can be reflected from the support. The electrical signal is passed through an analogue to digital converter and sent to memory in a digital computer together with locant information required for pixel location within the image. Except for the wavelength(s) chosen for scanning, successive image density scans, where employed, can be identical to the first.

One of the challenges encountered in producing images from information extracted by scanning is that the number of pixels of information available for viewing is only a fraction of that available from a comparable classical photographic print. It is therefore even more important in scan imaging to maximize the quality of the image information available. Enhancing image sharpness and minimizing the impact of aberrant pixel signals (i.e., noise) are common approaches to enhancing image quality. A conventional technique for minimizing the impact of aberrant pixel signals is to adjust each pixel density reading to a weighted average value by factoring in readings from adjacent pixels, closer adjacent pixels being weighted more heavily. Although the invention is described in terms of point-by-point scanning, it is appreciated that conventional approaches to improving image quality are contemplated. Illustrative systems of scan signal manipulation, including techniques for maximizing the quality of image records, are disclosed by Bayer U.S. Pat. No. 4,553,165, Urabe et al U.S. Pat. No. 4,591,923, Sasaki et al U.S. Pat. No. 4,631,578, Alkofer U.S. Pat. No. 4,654,722, Yamada et al U.S. Pat. No. 4,670,793, Klees U.S. Pat. No. 4,694,342, Powell U.S. Pat. No. 4,805,031, Mayne et al U.S. Pat. No. 4,829,370, Abdulwahab U.S. Pat. No. 4,839,721, Matsunawa et al U.S. Pat. Nos. 4,841,361 and 4,937,662, Mizukoshi et al U.S. Pat. No. 4,891,713, Petilli U.S. Pat. No. 4,912,569, Sullivan et al U.S. Pat. No. 4,920,501, Kimoto et al U.S. Pat. No. 4,929,979, Klees U.S. Pat. No. 4,962,542, Hirosawa et al U.S. Pat. No. 4,972,256, Kaplan U.S. Pat. No. 4,977,521, Sakai U.S. Pat. No. 4,979,027, Ng U.S. Pat. No. 5,003,494, Katayama et al U.S. Pat. No. 5,008,950, Kimura et al U.S. Pat. No. 5,065,255, Osamu et al U.S. Pat. No. 5,051,842, Lee et al U.S. Pat. No. 5,012,333, Sullivan et al U.S. Pat. No. 5,070,413, Bowers et al U.S. Pat. No. 5,107,346, Telle U.S. Pat. No. 5,105,266, MacDonald et al U.S. Pat. No. 5,105,469, and Kwon et al U.S. Pat. No. 5,081,692, the disclosures of which are here incorporated by reference.

Structure I has been described above in terms of a simple construction in which dye images are formed in each of the first and second emulsion layers to provide spectrally distinguishable images. It is recognized in U.S. Ser. No. 905,597, cited above, that only one of the emulsion layers need form a dye image on processing in order to produce spectrally distinguishable images in the first and second emulsion layers, since the silver image in the remaining emulsion layer can be spectrally distinguished from the dye image. To retain a silver image in one emulsion layer it is contemplated to eliminate the bleaching step during processing. This has the advantage of simplifying photographic processing as well as simplifying the structure of the photographic element by omitting one image dye.

Silver is known to have a relatively uniform optical density extending throughout the visible spectrum and into the near infrared. Thus, it is possible to scan the silver image in a spectral region in which the image dye exhibits negligible absorption. There are, however, two complications to scanning attributable to retention of developed silver in the photographic element. First, it is not possible to scan the dye image and obtain a density that is solely the density of the dye image, since the silver that is present in the photographic element absorbs in all spectral regions where the image dye absorbs. Second, in omitting the bleaching step to leave a needed silver image in one emulsion layer, a silver image that is not needed or wanted is also left in the emulsion layer containing image dye.

Simons and Sutton U.S. Ser. No. 966,623, filed Oct. 26, 1993, commonly assigned, titled PROCESS FOR THE EXTRACTION OF SPECTRAL IMAGE RECORDS FROM DYE IMAGE FORMING PHOTOGRAPHIC ELEMENTS, discloses a method for extracting N+1 independent image records from a photographic element containing N dye plus silver records and one silver only record. In Structure I (wherein N=1) the photographic element is scanned after processing without bleaching in a first spectral region in which the image dye and silver absorbs and in a second spectral region in which only the silver absorbs. This produces two separate density records, a dye plus silver image density record and a silver density record. By subtracting the silver density record from the dye plus silver density record a dye image record is obtained that provides one exposure record. From an empirical knowledge of the relationship between image dye density and the density of silver that accompanies it (information that can be readily generated from a single emulsion layer photographic element), it is possible to subtract the silver density contribution of the image dye containing layer from the overall silver density record. This leaves a second independent image record of just the silver density present in the emulsion layer that does not contain dye. Hence, two independent exposure records can be obtained from the photographic element even though only one emulsion layer forms a dye image.

It is important to note that the procedure described above of obtaining two independent image records can be employed even when all of the emulsion layers contain an image dye, provided the absorptions of the image dyes are spectrally distinguishable. The bleaching step of the process can still be eliminated, and the extra image dye can be scanned, if desired, to provide a check on the accuracy of information obtained from the remaining, required scanning.

Structure I above was chosen to demonstrate the simplest photographic element contemplated for practicing the invention. It is recognized that Structure I could be readily expanded to include 3, 4, 5 or even more emulsion layers bearing the same relationships as described above for the first and second emulsion layers. With each successive layer the theoretically available enhancement in photographic properties is increased, but this must be balanced against the increased complexity of the structure in terms of the number of layers and image dyes required.

When two or more image dye providing emulsion layers are employed in combination with an emulsion layer that produces only a silver image, scanning in the spectral regions in which each of the image dyes exhibit peak absorptions is required as well as in a spectral region in which significant absorption is attributable to only the developed silver. The procedures for resolving the multiple density records into separate image records when one spectral region is recorded only as a silver image is taught by Simons and Sutton U.S. Ser. No. 966,623, filed Oct. 26, 1993, commonly assigned, titled PROCESS FOR THE EXTRACTION OF SPECTRAL IMAGE RECORDS FROM DYE IMAGE FORMING PHOTOGRAPHIC ELEMENTS.

It is also recognized that the 2 to 5 or more emulsion layers for recording exposures in the same region of the spectrum need not be the only emulsion layers present. If desired, additional emulsion layers can be coated that respond to different regions of the spectrum. It is, in fact, contemplated to have 1, 2, 3 or more sets of emulsion layers differing in threshold sensitivities wherein each set is intended to record imagewise exposures in the same region of the spectrum.

In the discussion of the invention it is assumed for simplicity that the absorption in a selected spectral region is attributable to only one dye or one dye in combination with silver. It is, in fact, preferred to avoid or minimize overlapping absorptions by the different image dyes. When significant overlapping absorptions are presented by two or more image dyes, the observed densities should be converted to actual individual dye densities (usually referred to as analytical densities) by conventional calculation procedures, such as those discussed by James *The Theory of the Photographic Process*, 4th Ed., Macmillan, N.Y., 1977, Chapter 18, Sensitometry of Color Films and Papers, Section 3. Density Measurements of Color Film Images and Section 4. Density Measurements of Color Paper Images, pp. 520–529, the disclosure of which is here incorporated by reference.

The following are illustrations of specific contemplated applications of the invention:

Black-and-White Imaging

An illustrative photographic element for black-and-white photography is illustrated by Structure II:

| Structure II |
|---|
| Fast Emulsion Layer |
| Interlayer #1 |
| Mid Emulsion Layer |
| Interlayer #2 |
| Slow Emulsion Layer |
| Transparent Film Support |
| Antihalation Layer |

The slow, mid and fast emulsion layers are each panchromatically sensitized and each exhibit a different threshold sensitivity. The preferred silver halide emulsions are silver bromoiodide negative-working emulsions. Negative-working emulsions are preferred, since they are simpler both in their structure and photographic processing. Silver bromoiodide grain compositions provide the most favorable relationship of photographic sensitivity (speed) to granularity (noise) and are generally preferred for camera speed (>ISO 25) imaging. While any conventional iodide level can be employed, only low levels of iodide are required for increased sensitivity. Iodide levels as low as 0.5 mole percent, based on total silver are contemplated in preferred embodiments. The high levels of iodide conventionally relied upon for development inhibition to optimize the dye image are not required or preferred, since iodide retards the rate of development. Relatively rapid (less than 1 minute from exposed film input to dry negative) rates of photographic processing can be realized when the iodide level is maintained below 5 (optimally below 3) mole percent, based on total silver. Although the preferred emulsions are referred to as silver bromoiodide emulsions, it is appreciated that minor amounts of chloride can be present. For example, silver bromoiodide grains that are epitaxially silver chloride sensitized are specifically contemplated. Examples of such emulsions are provided by Maskasky U.S. Pat. Nos. 4,435,501 and 4,463,087.

Optimum photographic performance is realized when the silver bromoiodide emulsions are tabular grain emulsions. As employed herein the term "tabular grain emulsion" refers to an emulsion in which greater than 50 percent (preferably greater than 70 percent) of the total grain projected area is accounted for by tabular grains. For the green and red recording layer units preferred tabular grain emulsions are those in which the projected area criterion above is satisfied by tabular grains having a thickness of less than 0.3 μm (optimally less than 0.2 μm), an average aspect ratio (ECD/t) of greater than 8 (optimally greater than 12), and/or an average tabularity ($ECD/t^2$) of greater than 25 (optimally greater than 100), where ECD is the mean equivalent circular diameter and t is the mean thickness of the tabular grains, both measured in micrometers (μm). Specific examples of preferred silver bromoiodide emulsions include *Research Disclosure,* Item 22534, January 1983; Wilgus et al U.S. Pat. No. 4,434,426; Kofron et al U.S. Pat. No. 4,439,520; Daubendiek et al U.S. Pat. Nos. 4,414,310, 4,672,027, 4,693,964 and 4,914,014; Solberg et al U.S. Pat. No. 4,433,048; the Maskasky patents cited above; and Piggin et al U.S. Pat. Nos. 5,061,609 and 5,061,616, the disclosures of which are here incorporated by reference. Examples of preferred tabular grain emulsions other than silver bromoiodide emulsions are provided by *Research Disclosure,* Item 308119, above Section I, sub-section A, and Item 22534, both cited above.

Following imagewise exposure and processing each of the emulsion layers are capable of producing a spectrally distinguishable image. At least two of the emulsion layers produce a dye image, and for maximum scanning simplicity each of the emulsion layers is processed to form a dye only image. In a specifically preferred form of the invention dye images are produced by dye-forming couplers. Couplers capable of forming yellow, magenta, cyan and near infrared absorbing dyes on development are preferred. The couplers forming yellow, magenta and cyan dyes are preferred, since a large selection of photographically optimized couplers of these types are known and in current use in silver halide photography (refer to *Research Disclosure,* Item 308119, Section VII, cited above, and to James *The Theory of the Photographic Process,* 4th Ed., Macmillan, N.Y., 1977, Chapter 12, Section III, pp. 353–363). Couplers capable of forming near infrared absorbing image dyes are preferred, since the more efficient solid state lasers, useful in scanning, emit in the near infrared. Examples of infrared absorber dye forming couplers are contained in Ciurca et al U.S. Pat. No. 4,178,183.

While not essential, each emulsion layer containing a dye-forming coupler or other conventional dye image providing material can have its image structure improved by also including a material capable of inhibiting development, such as a development inhibitor releasing (DIR) coupler. DIR couplers of any conventional type can be incorporated in any layer of the film element, including interlayers and any emulsion layer that does not form a dye image. Exemplary development inhibitors are illustrated by Whirmore et al U.S. Pat. No. 3,148,062, Barret al U.S. Pat. No. 3,227,554, Hotta et al U.S. Pat. No. 4,409,323, Harder U.S. Pat. No. 4,684,604, and Adachi et al U.S. Pat. No. 4,740,453, the disclosures of which are here incorporated by reference.

Interlayers #1 and #2 are hydrophilic colloid layers each containing a conventional oxidized developing agent scavenger to minimize or eliminate color contamination by oxidized developing agent diffusion from one emulsion layer to a next adjacent layer. Oxidized developing agent scavengers are described in *Research Disclosure,* Item 308119, cited above, Section VII, sub-section I.

A conventional processing solution decolorizable antihalation layer is shown coated on the surface of the transparent film support opposite the emulsion layer units. Alternatively, the antihalation layer can be located between the slow emulsion layer and the support. At the latter location it is more effective in improving image sharpness, since reflection at the interface of the red recording unit and the support is minimized, but at this location it is also less accessible to the processing solutions. Specific examples of antihalation materials and their decoloration are provided by *Research Disclosure,* Item 308119, cited above, Section VIII, sub-sections C and D. An antihalation layer is a preferred feature, but not essential to imaging.

It is a specific advantage of this invention that high signal to noise ratios can be realized and that dye image integrity can be preserved even when the oxidized developing agent scavenger containing interlayers are omitted. In classical color photography to obtain a dye image of the highest signal to noise ratio an image recording layer unit is provided made up of a set of emulsion layers of differing threshold sensitivities intended to record exposures in the same region of the spectrum. Since the dye image formed in each emulsion layer of the set is of the same hue, the resulting overall dye image cannot be resolved into its component contributions by the individual layers of the set. If each emulsion layer is provided with sufficient dye image providing material (usually a dye-forming coupler) to react with all oxidized developing agent produced by silver halide development, the result is a photographic image that suffers from a high level of granularity (noise). The most common approach to reducing image granularity is to "coupler starve" at least the fastest of the emulsion layers. The term "coupler starve" means simply that there is a stoichiometric deficiency of dye image providing material. Thus, at a selected exposure level above threshold sensitivity all of the available dye image providing material is reacted and any additional oxidized developing agent formed as a result of the higher levels of exposure of the emulsion layer does not produce any additional dye. This eliminates the unneeded noisy imaging contribution of the fastest emulsion layer at higher exposure levels, but leaves an excess of oxidized developing agent that, if left unchecked, will diffuse to adjacent emulsion layers and degrade their image records. Thus, in classical color photography both oxidized developing agent scavenger containing interlayers and coupler starvation are the attributes of color photographic elements that exhibit the highest performance levels attainable.

In the present invention the fast, mid and slow emulsion layers each produce an image that is spectrally distinguishable. It is therefore entirely unnecessary to resort to coupler starvation or any comparable stoichiometric deficiency of dye image providing material (although neither are precluded). One of the distinct advantages of the present invention is that each of the emulsion layers can contain from 75 (preferably 100) to 200 (preferably 150) percent of the dye image providing material (e.g., coupler) required to react with all of the oxidized developing agent formed by maximum silver halide development during processing. The term "coupler rich" is hereinafter employed to indicate dye image providing material incorporation within these ranges. Conventional coupler starved layers typically contain from 10 to 50 percent of the coupler required to react with all of the oxidized developing agent formed by maximum silver halide development during processing. Using coupler rich layers in the practice of the invention does not increase imaging noise and minimizes oxidized developing agent wandering to adjacent layers, thereby allowing the dye image integrity of adjacent emulsion layers to be preserved without adding to element complexity by providing separate interlayers to perform this function. Another important advantage realized by coupler rich emulsion layers is that latent image bleaching (and hence speed loss) attributable to intralayer wandering of oxidized developing agent is also minimized.

Three separate image records are provided by Structure II that can be extracted by scanning and then combined selectively to produce a higher signal to noise ratio than can be realized by scanning a comparable classical dye image or silver image providing photographic element. In constructing a composite image from the individual image records extracted from Structure II the general approach is to give preferential weighting to the image record that contains the highest signal to noise ratio. Generally each image record will be superior to all other image records within one range of exposures.

To appreciate how to weight the image records in arriving at a superior composite image record it is necessary to review briefly photographic sensitometry and the nature of photographic noise. When a single emulsion layer photographic element is exposed through a step tablet and processed, a series of step images, each of a uniform density and of a density differing from that of all other steps, is obtained. From a knowledge of the structure of the step tablet the exposure difference from step to step is known. Note that only relative rather than absolute exposure levels are required. From this information a characteristic curve of the photographic element can be plotted. The characteristic curve is a plot of density (D) versus log exposure (log E) where exposure is in units of lux-seconds. Density is, of course, also a logarithmic unit, since density is the negative log of transmittance (T). By plotting the characteristic curve using two log scales an approximation of the visual response of the human eye is obtained. Computer manipulation of data related to logarithmic log E and density scales or linear exposure (E) and transmittance scales (T) are both common.

While a characteristic curve is an indispensable predictor of photographic performance, it is possible for two different photographic elements to produce identical characteristic curves while producing images of highly unequal quality. Characteristic curves are constructed by plotting average density against average log exposure. They provide no information about noise. If one of the density steps used to construct the characteristic curve is scanned point by point until a statistically significant number of points are obtained (e.g., if pixel by pixel scanning of the density step image is undertaken), density will vary from point to point. It is the customary simplification in photographic sensitometry to assume uniform light exposure and to impute the point to point fluctuations in density entirely to the film as a measure of the film's granularity. From this viewpoint each point density deviation from average density is viewed as a failure of the film to record the proper image density. It is alternatively possible to assume that the film has at each point in fact recorded the proper density for its level of exposure. From this viewpoint every point density deviation from average density is viewed as failure of the film to receive a proper exposure. It is well documented that all silver halide photographic elements exhibit granularity and that all light sources exhibit a Poisson distribution of light quanta. Fortunately, it is not necessary in assessing image structure quantitatively to distinguish the source of the point image deviations (noise). Mathematically the point image deviation can be treated as either a density variance or an exposure variance.

For mathematical compatibility with other scanned image information manipulations it is preferred to treat the point image deviation as an exposure error. By exposing a sample of Structure II through a step tablet and photographically processing it is possible to create a characteristic curve corresponding to each of the image records produced by the fast, mid and slow emulsion layers. When each step image is scanned pixel by pixel, the standard deviation (G) of the exposure of each emulsion layer at each step image density level can be determined and by interpolation the standard deviation of any subtended density level can be accurately estimated. This information can be used to assign an exposure level to each pixel of an imagewise exposed sample of Structure II that is more accurate (exhibits a lower standard deviation) than can be derived from any of the three image records independently. This is achieved by assigning an exposure value to each pixel using the following equation:

$$E_{best} = \frac{(E_f \div \sigma_f^2) + (E_m \div \sigma_m^2) + (E_s \div \sigma_s^2)}{(1 \div \sigma_f^2) + (1 \div \sigma_m^2) + (1 \div \sigma_s^2)} \quad \text{(I)}$$

where $E_{best}$ is the lowest noise record of pixel exposure attainable;

$E_f$, $E_m$ and $E_s$ are the exposure levels that correlate with the observed pixel densities of the fast, mid and slow emulsion layers using the characteristic curves of these emulsion layers, and $\sigma_f$, $\sigma_m$ and $\sigma_s$ are the standard exposure deviations of the fast, mid and slow emulsion layers at their observed pixel image densities.

By employing formula I it is possible to synthesize from the individual pixel image records of Structure II an image record that exhibits a higher signal to noise ratio than can be obtained with any comparable conventional photographic element. Specifically, Structure IIC-1 (Structure II modified so that spectrally indistinguishable dye images are produced by the fast, mid and slow emulsion layers) provides image information obtained by scanning that contains a higher noise component than is provided by Structure II. This is true even when the fast, mid and slow emulsion layers in Structure II are coupler rich while the fast and mid emulsion layers in Structure IIC-1 are coupler starved. Further, Structure IIC-2 (Structure II modified by blending the fast, mid and slow emulsion layers and employing a single image dye in the blended emulsion layer) exhibits an image structure that contains a higher noise component than either Structure II or Structure IIC-1.

Structure II is a black-and-white photographic element in the sense that it is used to form a single image of a single hue. The image that is synthesized from the scanned image information is comparable to the silver image of a classical black-and-white photographic element, but highly superior in its image structure. If Structure II were scanned in a spectral region in which only silver density was in evidence, the image obtained would have a much higher noise component that Structure II employed as contemplated by the invention. The same result would obtain if the image dye providing materials were entirely omitted from Structure II and the silver image density were scanned. The present invention then offers an approach to forming black-and-white photographic records that are highly superior in image structure to conventional black-and-white photographic records formed using photographic elements of comparable speed ratings.

Although Structure II has been described in terms of three separate emulsion layers, it is appreciated that the same principles apply to the construction of photographic elements according to the invention having from 2 to 5 or more emulsion layers. For a photographic element according to the invention containing "n" emulsion layers differing in threshold sensitivity, responsive to exposure within the same region of the spectrum and capable of producing spectrally distinguishable images formula I above can be generalized as follows:

$$E_{best} = \frac{\Sigma(E_n \div \sigma_n^2)}{\Sigma(1 \div \sigma_n^2)} \quad \text{(II)}$$

where $E_{best}$ is as defined above and n is an integer representing "n" emulsion layers.

Instead of being panchromatically sensitized the fast, mid and slow emulsion layers can alternatively be orthochromatically sensitized when used for black-and-white imaging.

Multicolor Imaging

Multicolor photographic elements conventionally contain blue, green and red exposure recording layer units each containing at least one silver halide emulsion layer. When modified to record exposures in only one region of the spectrum, the fast, mid and slow emulsion layers of Structure II above can, if desired, form one exposure recording layer unit of a multicolor photographic element. For example, if the fast, mid and slow emulsion layers of Structure II above are red sensitized, Structure II can be converted to a multicolor photographic element merely by overcoating conventional green and blue recording layer units containing magenta and yellow image dye providing materials, respectively. Oxidized developing agent scavenger containing interlayers are preferably interposed between adjacent exposure recording layer units and, where silver bromoiodide emulsions are employed in the green and/or red recording layer units, a processing solution bleachable yellow absorber, such as Carey Lea silver (CLS) or a processing solution bleachable yellow dye, is located in the interlayer beneath the blue recording layer unit. In this instance the red recording layer unit formed by the fast, mid and slow emulsion layers of Structure II above must form at least two dye images and preferably, for scanning simplicity, three dye images that are spectrally distinguishable from each other and from the dye images in the blue and green recording layer units. For example, one of the fast, mid and slow emulsion layers can be constructed to form a dye image that exhibits a half peak absorption band in the 600 to 650 nm portion of the spectrum, a second of the emulsion layers can be constructed to form a dye image that exhibits a half peak absorption band in the 650 to 700 nm portion of the spectrum, and the remaining emulsion layer need form no dye image or can be constructed to form a dye image that exhibits a half peak absorption band in the near infrared.

The foregoing is, of course, only one example of a broad range of alternative multicolor photographic element constructions possible. Since the various images are intended to be scanned rather than viewed, there need be no correlation between the spectral region recorded and the hue of the dye image. Hence the blue, green and red recording layer units can form any convenient combination of spectrally distinguishable images. Further, any or all of the image recording layer units can be constructed to satisfy individually the requirements of the invention. For example, either or both of the overcoated blue and green recording layer units referred to above can contain fast, mid and slow emulsion layers each responsive to the same region of the spectrum, but differing in the hues of the dye images formed.

Any multicolor photographic element image recording layer unit that satisfies the requirements of the invention contains at least two emulsion layers and can contain up to 5 or more layers, as discussed above. It is generally preferred that the green recording layer unit contain at least as many or more emulsion layers (usually two or three) than any remaining image recording layer unit, since the eye obtains most of its image information from the green portion of the spectrum.

Structure III, described below, demonstrates one of numerous possible embodiments allowing plural independent image records to be obtained from emulsion layers recording within a shared portion of the spectrum. Structure III satisfies all of the requirements of the general discussion of Structure I and features not explicitly otherwise described preferably conform to the comparable features of Structure II described above.

| Structure III (a preferred embodiment) |
|---|
| Blue Recording Layer Unit |
| Interlayer #1 |
| Fast Green Recording Emulsion Layer |
| Interlayer #2 |
| Fast Red Recording Emulsion Layer |
| Interlayer #3 |
| Mid Green Recording Emulsion Layer |
| Interlayer #4 |
| Mid Red Recording Emulsion Layer |
| Interlayer #5 |
| Slow Green Recording Emulsion Layer |
| Interlayer #6 |
| Slow Red Recording Emulsion Layer |
| Antihalation Layer |
| Transparent Film Support |
| Auxiliary Information Layer |

The blue recording layer unit can take any convenient conventional form or can contain plural emulsion layers that satisfy the requirements of the invention, as noted in the discussion of Structure II variations above. Interlayers #1, #2, #3, #4, #5 and #6 can each contain an oxidized developing agent scavenger or, where adjacent emulsion layers are coupler rich, the oxidized developing agent and/or the entire interlayer can be omitted. When the green and/or red recording emulsion layers are silver bromoiodide emulsions, it is preferred that at least Interlayer #1 contain processing solution decolorizable yellow dye or CLS, as noted in connection with Structure II. The antihalation layer can take any convenient conventional form and can take any of the forms discussed above in connection with Structure II.

Structure III locates both the fast green and the fast red emulsion layers to receive exposing radiation prior to the slower red and green emulsion layers. The layer order arrangement is similar to and imparts the photographic advantages taught by Eeles et al U.S. Pat. No.

4,184,876, the disclosure of which is here incorporated by reference.

The independence of the image dye hue as compared to the spectral band recorded allows a very wide range of choices. The specific illustrative combination of Table I is only one of numerous alternative selections:

TABLE I

| LAYER UNIT | SPECTRAL BAND RECORDED (nm) | IMAGE DYE HALF PEAK ABS. BAND RANGE (nm) |
|---|---|---|
| Blue | <500 | 390–470 |
| Fast Green | 500–600 | 490–520 |
| Fast Red | 600–700 | 530–560 |
| Mid Green | 500–600 | No Image Dye |
| Mid Red | 600–700 | 570–600 |
| Slow Green | 500–600 | 610–640 |
| Slow Red | 600–700 | 650–690 |
| Auxiliary | Near IR | 710–900 |

Referring to Table I it is apparent that each of the three green recording emulsion layers can record within any convenient portion or all of the green spectrum, and each of the three red recording emulsion layers can record within any convenient portion or all of the red spectrum. The half peak absorption band ranges of the image dyes are, however, noncoextensive. As chosen above and as is preferred, the half peak absorption band ranges are each offset from all other half peak absorption band ranges. The individual image dyes chosen can exhibit half peak absorption bands that extend throughout the band range set out, but are preferably of the narrowest feasible half peak absorption that can be conveniently obtained within the allotted absorption band. Note further that while some of the half peak absorption bands are within the same spectral region as sensitivity, others are in an entirely different spectral region. In fact, the half peak absorption bands can be allocated to the recording layer units in any one of all possible combinations. The mid green recording emulsion layer is shown in Table I to be free of image dye, since a somewhat sharper image can be obtained in the recording layer unit relying on developed silver for image definition. All of the emulsion layers can, if desired, form a dye image. For example, in Structure III above, when an image dye is formed in the mid green emulsion layer, it can conveniently be a dye having a half peak absorption band in the near infrared chosen not to overlap the half peak absorption band of the image dye in the auxiliary layer. When one of the emulsion layers relies solely on silver to form a spectrally distinguishable image, the emulsion layer unit lacking image dye can be any one of the various emulsion layers. The only essential requirement is that each image dye have a spectral absorption band that allows it to be distinguished from all other image dyes.

The auxiliary information layer is shown in Structure III for the purpose of illustrating (1) that recording layer units can be present in addition to those required to produce the image of the subject being replicated and (2) that the location of recording layer units is not restricted to one side of the support. The auxiliary information layer can be used to incorporate into the photographic element a scannable record usefully stored with the photographic record. For example, the auxiliary information layer can be exposed with a code pattern indicative of the date, time, aperture, shutter speed, frame locant and/or film identification usefully correlated with the photographic image information. The back side (the side of the support opposite the emulsion layers) of the film can be conveniently exposed to auxiliary information immediately following shutter closure concluding imagewise exposure of the front side (the emulsion layer side) of the film. Films containing a magnetic recording layer, such as any of those disclosed in *Research Disclosure,* Item 34390, Nov. 1992, p. 869, are specifically contemplated.

In Structure III there are 6 image dye records (i.e., N=6) and an additional silver only record for a total of 7 (i.e., N+1) records. From the very broad half peak absorption bands allocated to the blue and auxiliary records it is clearly apparent that the spectral band width of from 390 to 900 nm is broad enough to accommodate a substantially larger number of image dye records while still selecting from among a broad range of conventional imaging dyes. However, 390 to 900 nm is only a fraction of the spectral range that can be accommodated by conventional silver halide photographic element constructions. The minimum practical exposure wavelength of a silver halide photographic element is generally recognized to be about 280 nm, where ultraviolet absorption by gelatin, the most common vehicle for layer construction, becomes significant. Simpson et al U.S. Pat. No. 4,619,892, cited above, discloses contemplated near infrared ranges for silver halide imaging of up to 1500 nm. Thus, an available overall image dye absorption band of from 280 to 1500 nm, a 1220 nm range, is available. For dye chromophore simplicity it is generally preferred to limit the working range of dye absorptions in the near infrared to 900 nm. However, this still leaves more than ample spectral band width to accommodate many more spectrally offset dye images than contained in Structure III. Thus, in the overwhelming majority of applications the simplest construction capable of meeting photographic requirements rather than the available image dye band width controls photographic element construction. If the preferred form of Structure III shown above is expanded to provide three separate blue recording layer units, a total of 9 image dye records (N=9) and one additional silver record for a total of 10 (N+1=10) separate image records are present. At the present stage of photographic imaging, this number of separate records is sufficient to serve adequately even the most demanding imaging requirements. There is not, however, any reason in theory that the number of separate image records in the photographic elements used on the practice of the process of the invention could not be increased, depending upon the future demands of the art for both speed and detail in photographic images.

It is appreciated that the preferred form of Structure III described above is only one of many varied recording layer unit arrangements that can be employed in the practice of the invention. For example, any of the varied Layer Order Arrangements I to VIII inclusive of Kofron et al U.S. Pat. No. 4,439,520, the disclosure of which is here incorporated by reference, are specifically contemplated. Still other layer order arrangements are disclosed by Ranz et al German OLS 2,704,797 and Lohman et al German OLS 2,622,923, 2,622,924 and 2,704,826.

While the invention has been described in terms of photographic elements that produce image dyes that are scanned within the emulsion layer unit in which they are formed, it is appreciated that, if desired, any one or all of the image dyes can be transferred to a separate receiver for scanning. This allows the transferred dye images to be scanned independently of any silver image. Color image transfer imaging systems easily adapted to the practice of the invention in view of the teachings above are summarized in *Research Disclosure,* Item 308119, cited above, Section XXIII, Item 15162 published November 1976, and Item 12331 published July 1974, the disclosures of which are here incorporated by reference.

Black-and-white prints provide the human eye with only luminance information, while color prints provide the eye with both chromatic and luminance information. The photographic elements employed in the practice of the invention need not and in preferred constructions do not have the capability of themselves displaying chromatic information properly balanced to replicate the natural hues of photographic subjects. While extracting both chromatic and luminance image information from the photographic elements by scanning allows a much broader range of photographic element constructions than are acceptable for classical imaging, the equipment for obtaining a visually acceptable image is not nearly as simple nor widely available as that used in classical photographic imaging. One of the particular advantages of the present invention is that luminance (e.g., black-and-white) images can be obtained that can be accessed either by photographic printing techniques or by comparatively simple single channel scanning techniques and that are optimally balanced for viewing, even in those preferred forms in which the chromatic image is not properly balanced for viewing.

The human eye derives slightly more than half its total image luminance information from the green portion of the spectrum. Only about 10 percent of luminance information is derived from the blue portion of the spectrum, and the remainder of luminance information is derived from the red portion of the spectrum. To facilitate access to luminance information the photographic elements employed in the practice of the invention are constructed so that the overall image density in a single spectral region chosen for scanning or printing after imagewise exposure and processing is derived from blue, green and red recording layer units in the same relative order as human eye sensitivity. It is within the routine skill Of the art to balance by empirical techniques the densities of the blue, green and red recording layer units in silver halide photographic elements. In the simplest possible construction, assuming identical silver halide emulsions of matched sensitivities in the blue, green and red emulsion layers, the relative ordering of silver density can be achieved merely by providing corresponding silver halide coating coverages in the blue, green and red recording emulsion layers and scanning in a spectral region in which image dye density is minimal. When scanning or printing is undertaken in a spectral region of image dye absorption, the developed silver plus image dye densities within the spectral region employed must be balanced.

While achieving an exact match between blue, green and red recording emulsion layer luminance records and the sensitivity of the human eye in these regions is possible, it is not necessary. The benefits can be largely realized merely by providing a luminance record that approximates the luminance spectral sensitivity profile of the human eye. For an approximately balanced luminance record it is preferred that the blue recording layer unit account for from 5 to 20 percent, the red recording emulsion layers account for from 20 to 40 percent, and the green recording emulsion layers account for at least 40 and preferably at least 50 percent of the image density of the luminance record.

Skim Coat Constructions

In Structures I, II and III above any conventional distribution of silver coating coverages (the weight or moles of silver present in silver halide per unit of layer surface area) can be present within each set of emulsion layers having different threshold sensitivities intended to record images in the same region of the spectrum. Generally the silver coating coverages are relatively proportionately balanced. Within an emulsion layer set made up of "n" layers typically the percentage of total silver contained in any one emulsion layer is $[(100/n)\pm 10]$ percent.

From the discussion above it is apparent that the fastest emulsion layer of the set makes a reduced contribution to overall image determination at exposure levels above the threshold sensitivity of the next fastest emulsion layer. An ideal solution from a theoretical viewpoint is to eliminate the portion of the silver halide in the fastest emulsion layer that requires an exposure in excess of that required to reach the threshold sensitivity of the next fastest emulsion layer so that the eliminated silver halide can be coated in remaining emulsion layer or layers of the set. Decreasing the exposure latitude of the fastest emulsion layer increases the proportion of the total silver halide in the fastest emulsion layer that is available for latent image formation prior to reaching the exposure level required to produce threshold sensitivity in the next fastest emulsion layer. Thus, in one form of the invention it is contemplated that the fastest emulsion layer in the set will also be the shortest exposure latitude emulsion layer.

Another approach to better utilizing silver halide in the emulsion layer set is to reduce relative to the remaining emulsion layers the silver coverage of the fastest emulsion layer in the set. The reduced silver coverage fastest emulsion layer is hereinafter referred to as a "skim coat" emulsion layer, since it is typically located to receive exposing radiation prior to the remaining emulsion layers of the set and can be viewed as "skimming off" only a fraction of the exposing radiation by absorption. Simply lowering the silver coverage of the fastest emulsion layer of the set has photographic advantages and disadvantages. One disadvantage is that lowering the silver coverage lowers the signal to noise ratio, regardless of which relative position the fastest emulsion layer occupies in the set. A significant advantage is that the speed and sharpness of the images produced in the underlying emulsion layer or layers in the set can be significantly increased, since reducing the silver coating coverage of the fastest emulsion layer decreases the number of silver halide grains in the fastest emulsion layer and reduces radiation scattering and absorption in passing through the fastest emulsion layer to the underlying emulsion layer or layers of the set.

An advantageous silver coating coverage for the fastest emulsion layer in the set as a percentage of the total silver coating coverage is 5 to 20 percent of the total silver coating coverage of all of the emulsion layers in the same set.

Structures Exhibiting Enhanced Image Sharpness

For many photographic applications obtaining the sharpest possible image outweighs achieving the highest attainable photographic speeds or even achieving the highest signal to noise ratio. To obtain the sharpest attainable image from the photographic elements of the invention it is contemplated to compare the sharpness of the individual images and to employ the sharpest individual image within each emulsion layer set to construct the final image, where the "emulsion layer set" is comprised of the emulsion layers differing in threshold sensitivity that record exposures in the same region of the spectrum.

Where the individual emulsion layers of a set have each been substantially optimally sensitized, so that the largest mean grain'size emulsion exhibits the highest speed and the smallest mean grain size emulsion exhibits the slowest speed, to synthesize the sharpest composite image attainable image information is taken exclusively from the emulsion layer that requires the least exposure to reach its threshold sensitivity level until the threshold sensitivity of the next fastest emulsion layer is reached. Image information is then selected exclusively from the next fastest emulsion layer. If a third emulsion layer having a threshold sensitivity at a third, higher exposure level is present, image information is taken exclusively from the third emulsion layer at exposures at and beyond its threshold sensitivity. By using information exclusively from the sharpest individual emulsion layer image available the sharpest attainable overall image is realized.

An example of layer arrangement that maximizes image sharpness is Structure IV:

| Structure IV |
|---|
| Mid Emulsion Layer |
| Interlayer #1 |
| Fast Emulsion Layer |
| Interlayer #2 |
| Slow Emulsion Layer |
| Transparent Film Support |
| Antihalation Layer |

Structure IV has all of the structural features of Structure II as described above, except that the mid emulsion layer is now positioned to receive exposing radiation prior to the remaining emulsion layers. The advantage of this arrangement is that the mid emulsion layer receives the most highly specular (least scattered) light of the three emulsion layers of the set. This is particularly advantageous, since the mid emulsion layer is recording mid-range exposure levels. The human eye is most discriminating in identifying image detail in the mid ranges of illumination. The eye does not pick out detail well in a brightly illuminated subject or in a twilight setting. Structure IV not only allows an image of the highest sharpness to be realized for mid-scale exposure levels, but also allows this sharpest image record to be separated from the image contributions of the fast and slow emulsion layers so that it can be used exclusively for replicating subject detail in mid-density ranges in a composite image constructed from the individual emulsion image records.

All of the variant forms and modifications of Structure II discussed above are also equally applicable to Structure IV and are therefore not redescribed. It is further apparent that the advantages of increased image sharpness can be obtained by modifying Structure III to interchange the coated positions of the fast and mid emulsion layers in each of the green and red recording sets.

Structure IV produces a sharper image, but exhibits an overall slightly slower speed than Structure II. It is possible to modify Structure IV so that it produces a still sharper image by interchanging the positions of the fast and slow emulsions. The resulting structure will have a slightly lower overall photographic speed than Structure IV.

Structures that Enhance Image Sharpness at Increasing Exposure Levels

Photographers realize that faster films offer the advantage of permitting successful image capture at lower light levels, but at the expense of lower overall image quality (i.e., lower signal-to-noise ratios) than can be realized by employing slower films. Thus, a common conflict that arises in preparing for photographic opportunities in which light level cannot be controlled is whether to load the camera with faster film to be certain of obtaining photographs under marginal lighting conditions or to load with slower film that will provide images exhibiting lower levels of granularity.

A layer order arrangement that allows both image capture at lower lighting levels and higher quality images at higher lighting levels is that obtained when the fastest emulsion layer of each recording layer unit is coated nearest to the support. This allows images to be captured at lower lighting levels by the fastest emulsion layer—that is, at lighting levels below the threshold sensitivity of all except the fastest emulsion layer while at the same time obtaining high image quality when exposure levels reach the threshold sensitivities of the slower emulsion layer or layers in the same recording layer unit. In a black-and-white film there is, of course, only a single recording layer unit, whereas in color photography there are normally three separate recording layer units.

An example of a layer arrangement that permits lower lighting level imaging while maximizing image sharpness at high lighting levels is Structure V:

| Structure V |
|---|
| Slow Emulsion Layer |
| Interlayer #1 |
| Mid Emulsion Layer |
| Interlayer #2 |
| Fast Emulsion Layer |
| Transparent Film Support |
| Antihalation Layer |

In Structure V the relative locations of the emulsion layers are chosen so that the location favoring maximum image sharpness is provided to the slowest of the emulsion layers, thereby allowing the film to exhibit the high image quality to be expected of films given lower exposure ratings while still retaining the ability of the film to achieve image capture at lower exposure levels. In the practice of the invention the image records provided by all three emulsion layers are obtained and compared. In each exposure range of interest the exposure record exhibiting the highest signal-to-noise ratio is used preferentially to form the image record. This usually results in the image recorded by the slowest of the emulsion layers being preferentially employed for image recording at exposure levels of above its threshold sensitivity. Below its threshold sensitivity, but above the threshold sensitivity of the mid emulsion layer unit, the exposure record of the latter generally provides a superior signal-to-noise image record. Generally, the image record provided by the fastest of the emulsion layers is used only by default-that is, at lower exposure levels below the sensitivity thresholds of the remaining emulsion layers.

Although Structure V has been described in terms of a single recording layer unit, expansion of the structure shown to one containing three recording layer units suitable for use in color photography is readily appreciated by those skilled in the art.

In describing comparisons of one emulsion layer property with a comparable property of one or more other emulsions the comparative descriptors (e.g., faster, fastest, sharper, sharpest, etc.) have been employed with no intention of limiting the comparison to two emulsion layers or more than two emulsion layers. Rather, it is to be understood that each recited comparison applies to both alternatives.

EXAMPLES

The invention can be better appreciated by reference to the following specific examples. In each of the examples coating densities, set out in bracket's ([ ]) are reported in terms of grams per square meter (g/m$^2$), except as specifically noted. Silver halide coverages are reported in terms of silver. All emulsions were sulfur and gold sensitized and spectrally sensitized to the spectral region indicated by the layer title. Dye-forming couplers were dispersed in gelatin solution in the presence of approximately equal amounts of coupler solvents, such as tricresyl phosphate, dibutyl phthalate, or diethyl lauramide.

Example 1

A photographic film (Invention Film #1) useful for the practice of the invention was prepared by coating onto a transparent photographic film support. A processing solution decolorizable antihalation layer was coated on the back side of the film support. The following layers were coated to prepare Invention Film #1 beginning with the layer closest to the film support:

Invention Film #1

Layer 1: Gelatin Undercoat
- Gelatin [4.9].

Layer 2: Slow Green Sensitive Recording Layer
- Gelatin [1.7];
- Super-slow green-sensitized silver bromoiodide tabular grain emulsion (4.0 mole % iodide, mean grain projected area 0.5 μm$^2$, mean grain thickness 0.09 μm) [0.54];
- Slow green-sensitized silver bromoiodide tabular grain emulsion (4.0 mole % iodide, mean grain projected area 0.9 μm$^2$, mean grain thickness 0.10 μm) [0.54];
- Cyan dye forming coupler (1) [1.08].

Layer 3: Medium Green Sensitive Recording Layer
- Gelatin [1.7];
- Medium green-sensitized silver bromoiodide tabular grain emulsion (4.0 mole % iodide, mean grain projected area 1.2 μm$^2$, mean grain thickness 0.12 μm) [1.08];
- Magenta dye forming coupler (2) [1.08].

Layer 4: Fast Green Sensitive Recording Layer
- Gelatin [1.7];
- Fast green-sensitized silver bromoiodide tabular grain emulsion (4.0 mole % iodide, mean grain projected area 2.5 μm$^2$, mean grain thickness 0.13 μm) [1.08];
- Yellow dye forming coupler (3) [1.08].

Layer 5: Supercoat
- Gelatin [1.6];
- Bis (vinylsulfonyl) methane [0.2].

Cyan dye forming coupler (1) had the following structure:

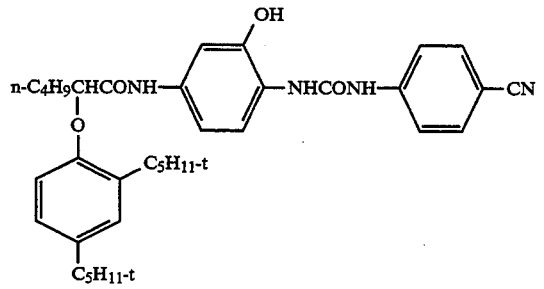

Magenta dye forming coupler (2) had the following structure:

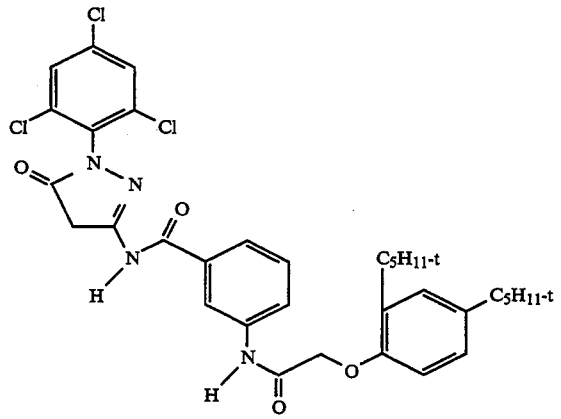

Yellow dye forming coupler (3) had the following structure:

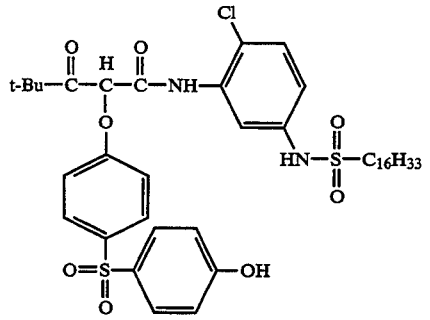

In addition to the components specified above, 4-hydroxy-6-methyl-1,3,3A,7-tetraazindene, sodium salt was included in each emulsion containing layer at a level of 1.75 grams per mole of silver halide. Surfactants were included in all layers to facilitate coating.

Comparison Film #1 was prepared by coating onto a transparent film support. A processing solution decolorizable antihalation layer was coated on the back side of the support. The following layers were coated for the comparison film beginning with the layer closest to the support:

Comparison Film #1

Layer 1: Gelatin Undercoat
- Gelatin [4.9].

Layer 2: Green Sensitive Recording Layer
- Gelatin [4.28];

Super-slow green-sensitized silver bromoiodide tabular grain emulsion (4.0 mole % iodide, mean grain projected area 0.5 $\mu m^2$, mean grain thickness 0.09 $\mu m$) [0.54];

Slow green-sensitized silver bromoiodide tabular grain emulsion (4.0 mole % iodide, mean grain projected area 0.9 $\mu m^2$, mean grain thickness 0.10 $\mu m$) [0.54];

Medium green-sensitized silver bromoiodide tabular grain emulsion (4.0 mole % iodide, mean grain projected area 1.2 $\mu m^2$, mean grain thickness 0.12 $\mu m$) [1.08];

Fast green-sensitized silver bromoiodide tabular grain emulsion (4.0 mole % iodide, mean grain projected area 2.5 $\mu m^2$, mean grain thickness 0.13 $\mu m$) [1.08];

Magenta dye forming coupler (2) [2.16].

Layer 3: Supercoat

Gelatin [1.6];

Bis(vinylsulfonyl)methane [0.19].

In addition to the components specified above, 4-hydroxy-6-methyl-1,3,3A,7-tetraazindene, sodium salt was included in each emulsion containing layer at a level of 1.75 grams per mole of silver halide. Surfactants were included in all layers to facilitate coating.

Comparison Film #2 was prepared by coating onto a transparent film support. A processing solution decolorizable anti-halation layer was coated on the back side of the support. The following layers were coated for the comparison film beginning with the layer closest to the support:

Comparison Film #2

Layer 1: Gelatin Undercoat

Gelatin [4.9].

Layer 2: Slow Green Sensitive Recording Layer

Gelatin [1.7];

Super-slow green-sensitized silver bromoiodide tabular grain emulsion (4.0 mole % iodide, mean grain projected area 0.5 $\mu m^2$, mean grain thickness 0.09 $\mu m$) [0.54];

Slow green-sensitized silver bromoiodide tabular grain emulsion (4.0 mole % iodide, mean grain projected area 0.9 $\mu m^2$, mean grain thickness 0.10 $\mu m$) [0.54];

Magenta dye forming coupler (2) [1.08].

Layer 3: Medium Green Sensitive Recording Layer

Gelatin [1.7];

Medium green-sensitized silver bromoiodide tabular grain emulsion (4.0 mole % iodide, mean grain projected area 1.2 $\mu m^2$, mean grain thickness 0.12 $\mu m$) [1.08];

Magenta dye forming coupler (2) [1.08].

Layer 4: Fast Green Sensitive Recording Layer

Gelatin [1.7];

Fast green-sensitized silver bromoiodide tabular grain emulsion (4.0 mole % iodide, mean grain projected area 2.5 $\mu m^2$, mean grain thickness 0.13 $\mu m$) [1.08];

Magenta dye forming Coupler (2) [1.08].

Layer 5: Supercoat

Gelatin [1.6];

Bis (vinylsulfonyl)methane [0.2].

In addition to the components specified above, 4-hydroxy-6-methyl-1,3,3A,7-tetraazindene, sodium salt was included in each emulsion containing layer at a level of 1.75 grams per mole of silver halide. Surfactants were included in all layers to facilitate coating.

Samples of the invention and comparison films described above were exposed in a sensitometer using a daylight balanced light source (5500° K.) passed through a Kodak Wratten TM #9 (yellow) Filter and a graduated neutral density step wedge. The exposed film was processed according to the following procedure:

1. Develop in Kodak Flexicolor C41 TM developer at 38° C. (2.5 minutes).
2. Bleach in Kodak Flexicolor C41 TM bleach (4 minutes).
3. Wash (3 minutes).
4. Fix in Kodak Flexicolor C41 TM fixer (4 minutes).
5. Wash (4 minutes).
6. Dry film.

Red, green, and blue point transmittances (actually, point approximations made using a restricted aperture for sampling) were measured for uniformly exposed areas of the processed films using a transmission optoelectronic scanning device having status M sensitivities. One thousand data points were measured for each exposure level given. The transmittance in the spectral region corresponding to the absorption maximum of the formed image dye was used except as noted. The blue transmittance of the comparison films (due to sideband absorption of the magenta image dye) was analyzed because the transmittance in the green region was too low at higher exposure levels to yield reliable results. The mean transmittance was calculated using conventional methods for every input exposure. Table II summarizes this data for the three films.

TABLE II

| Relative Log Input Exposure | Transmittance | | | | |
|---|---|---|---|---|---|
| | Invention Film #1 | | | Comparison Film #1 | Comparison Film #2 |
| | Layer #1 | Layer #2 | Layer #3 | | |
| 0.0 | 0.8222 | 0.4315 | 0.3664 | 0.6934 | 0.6109 |
| 0.2 | 0.8204 | 0.4093 | 0.3251 | 0.6823 | 0.5984 |
| 0.4 | 0.8166 | 0.3811 | 0.2559 | 0.6427 | 0.5689 |
| 0.6 | 0.8072 | 0.3243 | 0.1531 | 0.5808 | 0.5260 |
| 0.8 | 0.7889 | 0.2438 | 0.0692 | 0.4831 | 0.4667 |
| 1.0 | 0.7516 | 0.1528 | 0.0293 | 0.3776 | 0.4027 |
| 1.2 | 0.6871 | 0.0736 | 0.0142 | 0.2924 | 0.3396 |
| 1.4 | 0.6026 | 0.0278 | 0.0086 | 0.2296 | 0.2825 |
| 1.6 | 0.5035 | 0.0101 | 0.0055 | 0.1888 | 0.2383 |
| 1.8 | 0.3999 | 0.0053 | 0.0042 | 0.1607 | 0.2018 |
| 2.0 | 0.2851 | 0.0036 | 0.0033 | 0.1409 | 0.1750 |
| 2.2 | 0.1919 | 0.0028 | 0.0027 | 0.1256 | 0.1542 |
| 2.4 | 0.1253 | 0.0025 | 0.0025 | 0.1189 | 0.1377 |
| 2.6 | 0.0824 | 0.0023 | 0.0022 | 0.1067 | 0.1259 |
| 2.8 | 0.0590 | 0.0021 | 0.0021 | 0.0964 | 0.1146 |
| 3.0 | 0.0399 | 0.0018 | 0.0020 | 0.0914 | 0.1059 |

The available data points were interpolated using conventional methods of cubic spline interpolation to specify an apparent input exposure level for every possible film transmittance. Each of the one thousand data points for each exposure level and film record were converted to the corresponding apparent input exposure level using the interpolated relationships between film transmittance and input exposure level. The standard deviation of the apparent input exposures was calculated for each exposure level and film layer using conventional methods. Table III summarizes the standard deviation of the apparent input exposure for each layer of Invention Film #1 at each level of exposure. The available data points were interpolated using conventional methods of cubic spline interpolation to specify the standard deviation of the apparent input exposure for each possible level of input exposure.

TABLE III

| Relative Log Input Exposure | Standard Deviation Invention Film #1 | | |
|---|---|---|---|
| | Layer #1 | Layer #2 | Layer #3 |
| 0.0 | 7.3 | 4.9 | 2.3 |
| 0.2 | 11.9 | 3.0 | 2.1 |
| 0.4 | 7.3 | 3.3 | 1.7 |
| 0.6 | 5.3 | 2.2 | 1.7 |
| 0.8 | 4.4 | 2.5 | 2.2 |
| 1.0 | 3.6 | 2.7 | 3.7 |
| 1.2 | 4.1 | 3.5 | 7.3 |
| 1.4 | 5.7 | 5.0 | 12.8 |
| 1.6 | 8.3 | 9.2 | 23.7 |
| 1.8 | 13.2 | 23.9 | 55.3 |
| 2.0 | 17.9 | 57.0 | 79.0 |
| 2.2 | 33.4 | 191.8 | 237.3 |
| 2.4 | 55.0 | 381.4 | 472.2 |
| 2.6 | 118.7 | 763.0 | 456.9 |
| 2.8 | 192.8 | 791.4 | 2153.6 |
| 3.0 | 245.6 | 912.0 | 3334.1 |

The apparent exposure for each pixel of the invention film was determined by the weighted summation of the apparent input exposures determined for the three spectrally distinguishable imaging layers using Equation I. The standard deviation was calculated for the newly determined apparent input exposures. Table IV summarizes the standard deviation of the apparent input exposure (the inverse of signal-to-noise ratio) of the invention film after averaging and the two comparison films. The uncertainty in the apparent exposure of the invention is seen to be comparable and in most instances less than that of either comparison film at all exposure levels.

A new piece of each film was exposed in a photographic exposure device through a Kodak Wratten TM #9 Filter to form a latent image of the photographed scene and photographically processed and scanned as described above. This yielded a red, green, and blue transmittance triad for every point measured in the film images. The apparent input exposure was calculated for every point scanned for the invention film by mapping through the transmittance-exposure response curves of the calibration exposures and averaging the three determined input exposures according to equation I. The apparent input exposures for the comparison films were determined by mapping the measured transmittance values for every point scanned through the transmittance-exposure response curves determined for the calibration exposures given each film, respectively.

TABLE IV

| Relative Log Input Exposure | Standard Deviation | | |
|---|---|---|---|
| | Invention Fil #1 | Comparison Fil #1 | Comparison Fil #2 |
| 0.0 | 2.0 | 2.2 | 2.8 |
| 0.2 | 1.7 | 2.4 | 1.7 |
| 0.4 | 1.5 | 1.5 | 1.5 |
| 0.6 | 1.3 | 1.7 | 1.6 |
| 0.8 | 1.5 | 1.9 | 1.9 |
| 1.0 | 1.9 | 2.5 | 2.6 |
| 1.2 | 2.5 | 3.9 | 3.6 |
| 1.4 | 3.6 | 6.1 | 5.3 |
| 1.6 | 6.0 | 10.8 | 8.4 |
| 1.8 | 11.3 | 17.7 | 15.8 |
| 2.0 | 16.7 | 30.5 | 27.2 |
| 2.2 | 32.6 | 81.4 | 45.8 |
| 2.4 | 54.1 | 136.5 | 90.3 |
| 2.6 | 113.6 | 124.9 | 152.1 |
| 2.8 | 186.6 | 251.5 | 274.8 |
| 3.0 | 236.6 | 396.5 | 446.3 |

The derived input exposures for every point of the films scanned were used to drive a digital display. The apparent exposure levels determined by averaging of the three layers of the invention yielded a reproduction of the original scene that exhibited superior granularity compared to the image that was produced if only one of the imaging layers of the invention film was used to derive all input exposure levels. Additionally, the image produced by the invention exhibited lower granularity when compared to the comparison examples containing only one image record. This demonstrated the improved quality achievable by independently reading information recorded in each layer of a photographic recording unit containing more than one layer sensitized to respond to a single region of the spectrum.

Example 2

Example 1 was repeated with the exception that development inhibitor releasing coupler (DIR) was included in each of the image forming layers. Invention Film #2 was prepared by coating onto a transparent film support. A processing solution decolorizable antihalation layer was coated on the back side of the support. The following layers were coated beginning with the layer closest to the support:

Invention Film #2

Layer 1: Gelatin Undercoat
- Gelatin [4.9].

Layer 2: Slow Green Sensitive Recording Layer
- Gelatin [1.7];
- Super-slow green-sensitized silver bromoiodide tabular grain emulsion (4.0 mole % iodide, mean grain projected area 0.5 $\mu m^2$, mean grain thickness 0.09 $\mu m$) [0.54];
- Slow green-sensitized silver bromoiodide tabular grain emulsion (4.0 mole % iodide, mean grain projected area 0.9 $\mu m^2$, mean grain thickness 0.10 $\mu m$) [0.54];
- Cyan DIR coupler (4) [0.03];
- Cyan dye forming coupler (1) [1.08].

Layer 3: Medium Green Sensitive Recording Layer
- Gelatin [1.7];
- Medium green-sensitized silver bromoiodide tabular grain emulsion (4.0 mole % iodide, mean grain projected area 1.2 $\mu m^2$, mean grain thickness 0.12 $\mu m$) [1.08];
- Magenta DIR coupler (5) [0.03];
- Magenta dye forming coupler (2) [1.08].

Layer 4: Fast Green Sensitive Recording Layer
- Gelatin [1.7];
- Fast green-sensitized silver bromoiodide tabular grain emulsion (4.0 mole % iodide, mean grain projected area 2.5 $\mu m^2$, mean grain thickness 0.13 $\mu m$) [1.08];
- Yellow DIR coupler (6) [0.03];
- Yellow dye forming coupler (3) [1.08].

Layer 5: Supercoat
- Gelatin [1.6];
- Bis(vinylsulfonyl)methane [0.2].

In addition to the components specified above, 4-hydroxy-6-methyl-1,3,3A,7-tetraazindene, sodium salt was included in each emulsion containing layer at a level of 1.75 grams per mole of silver halide. Surfactants were included in all layers to facilitate coating.

Cyan DIR coupler (4) had the following structure:

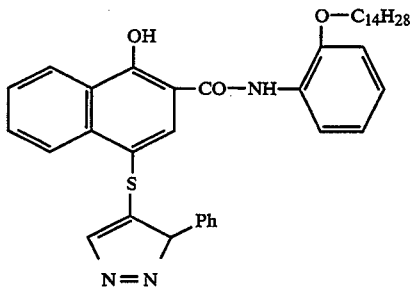

Magenta DIR coupler (5) had the following structure:

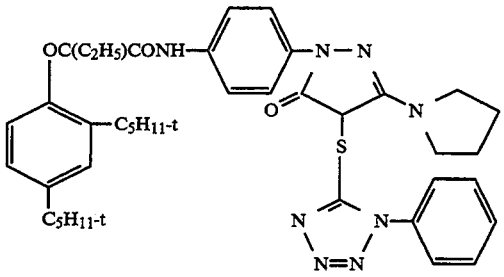

Yellow DIR coupler (6) had the following structure:

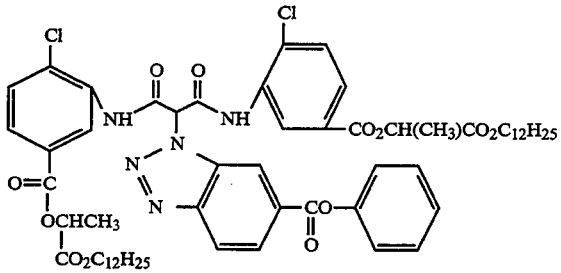

Comparison Film #3 was prepared by coating onto a transparent film support. A processing solution decolorizable anti-halation layer was coated on the back side of the support. The following layers were coated for the comparison film beginning with the layer closest to the support:

Comparison Film #3

Layer 1: Gelatin Undercoat
Gelatin [4.9].

Layer 2: Green Sensitive Recording Layer
Gelatin [4.28];
Super-slow green-sensitized silver bromoiodide tabular grain emulsion (4.0 mole % iodide, mean grain projected area 0.5 $\mu m^2$, mean grain thickness 0.09 $\mu m$) [0.54];
Slow green-sensitized silver bromoiodide tabular grain emulsion (4.0 mole % iodide, mean grain projected area 0.9 $\mu m^2$, mean grain thickness 0.10 $\mu m$) [0.54];
Medium green-sensitized silver bromoiodide tabular grain emulsion (4.0 mole % iodide, mean grain projected area 1.2 $\mu m^2$, mean grain thickness 0.12 $\mu m$) [1.08];
Fast green-sensitized silver bromoiodide tabular grain emulsion (4.0 mole % iodide, mean grain projected area 2.5 $\mu m^2$, mean grain thickness 0.13 $\mu m$) [1.08];
Magenta DIR coupler (5) [0.1];
Magenta dye forming coupler (2) [2.16].

Layer 3: Supercoat
Gelatin [1.6];
Bis (vinylsulfonyl)methane [0.19].

In addition to the components specified above, 4-hydroxy-6-methyl-1,3,3A,7-tetraazindene, sodium salt was included in each emulsion containing layer at a level of 1.75 grams per mole of silver halide. Surfactants were included in all layers to facilitate coating.

Comparison Film #4 was prepared by coating onto a transparent film support. A processing solution decolorizable anti-halation layer was coated on the back side of the support. The following layers were coated for the comparison film beginning with the layer closest to the support:

Comparison Film #4

Layer 1: Gelatin Undercoat
Gelatin [4.9].

Layer 2: Slow Green Sensitive Recording Layer
Gelatin [1.7];
Super-slow green-sensitized silver bromoiodide tabular grain emulsion (4.0 mole % iodide, mean grain projected area 0.5 $\mu m^2$, mean grain thickness 0.09 $\mu m$) [0.54];
Slow green-sensitized silver bromoiodide tabular grain emulsion (4.0 mole % iodide, mean grain projected area 0.9 $\mu m^2$, mean grain thickness 0.10 $\mu m$) [0.54];
Magenta DIR coupler (5) [0.03];
Magenta dye forming coupler (2) [1.08].

Layer 3: Medium Green Sensitive Recording Layer
Gelatin [1.7];
Medium green-sensitized silver bromoiodide tabular grain emulsion (4.0 mole % iodide, mean grain projected area 1.2 $\mu m^2$, mean grain thickness 0.12 $\mu m$) [1.08];
Magenta DIR coupler (5) [0.03];
Magenta dye forming coupler (2) [1.08].

Layer 4: Fast Green Sensitive Recording Layer
Gelatin [1.7];
Fast green-sensitized silver bromoiodide tabular grain emulsion (4.0 mole % iodide, mean grain projected area 2.5 $\mu m^2$, mean grain thickness 0.13 $\mu m$) [1.08];
Magenta DIR coupler (5) [0.03];
Magenta dye forming coupler (2) [1.08].

Layer 5: Supercoat
Gelatin [1.6];
Bis(vinylsulfonyl)methane [0.2].

In addition to the components specified above, 4-hydroxy-6-methyl-1,3,3A,7-tetraazindene, sodium salt was included in each emulsion containing layer at a level of 1.75 grams per mole of silver halide. Surfactants were included in all layers to facilitate coating.

Samples of the invention and the two comparison films, all containing DIR couplers in all imaging layers, were exposed, processed, scanned, and analyzed as described in Example 1. Tables V, VI, and VII summarize the calibration data and the standard deviations of the determined exposures for each exposure level and distinguishable film record.

As observed for Example 1, the uncertainty in the determined apparent exposure for the digitally processed film of the invention was comparable to and in most cases less than that of either of the two comparison films. Additionally, images recorded on these films and processed as described above exhibited improved granularity performance for the invention film compared to either of the comparison films, demonstrating the superior quality of images recorded using the invention.

TABLE V

| Relative Log Input Exposure | Transmittance | | | | |
|---|---|---|---|---|---|
| | Invention Film #2 | | | Comparison Film #3 | Comparison Film #4 |
| | Layer #1 | Layer #2 | Layer #3 | | |
| 0.0 | 0.8072 | 0.4112 | 0.4808 | 0.5649 | 0.3334 |
| 0.2 | 0.8072 | 0.4009 | 0.4406 | 0.5346 | 0.3192 |
| 0.4 | 0.8072 | 0.3864 | 0.3648 | 0.4753 | 0.2904 |
| 0.6 | 0.8054 | 0.3548 | 0.2399 | 0.3664 | 0.2382 |
| 0.8 | 0.8017 | 0.3162 | 0.1268 | 0.2382 | 0.1782 |
| 1.0 | 0.7852 | 0.2570 | 0.0622 | 0.1361 | 0.1216 |
| 1.2 | 0.7551 | 0.1963 | 0.0356 | 0.0753 | 0.0766 |
| 1.4 | 0.6998 | 0.1361 | 0.0217 | 0.0420 | 0.0444 |
| 1.6 | 0.6124 | 0.0883 | 0.0161 | 0.0250 | 0.0232 |
| 1.8 | 0.4989 | 0.0605 | 0.0126 | 0.0159 | 0.0123 |
| 2.0 | 0.3707 | 0.0474 | 0.0097 | 0.0111 | 0.0067 |
| 2.2 | 0.2588 | 0.0398 | 0.0074 | 0.0079 | 0.0041 |
| 2.4 | 0.1795 | 0.0344 | 0.0067 | 0.0064 | 0.0027 |
| 2.6 | 0.1282 | 0.0307 | 0.0063 | 0.0051 | 0.0019 |
| 2.8 | 0.0931 | 0.0272 | 0.0056 | 0.0037 | 0.0013 |
| 3.0 | 0.0687 | 0.0233 | 0.0046 | 0.0031 | 0.0010 |

TABLE VI

| Relative Log Input Exposure | Standard Deviation Invention Film #2 | | |
|---|---|---|---|
| | Layer #1 | Layer #2 | Layer #3 |
| 0.0 | — | 6.6 | 2.3 |
| 0.2 | — | 3.5 | 1.8 |
| 0.4 | — | 3.4 | 1.5 |
| 0.6 | 19.8 | 2.8 | 1.5 |
| 0.8 | 9.6 | 3.0 | 2.0 |
| 1.0 | 5.6 | 3.3 | 3.9 |
| 1.2 | 5.8 | 3.8 | 7.8 |
| 1.4 | 6.1 | 4.7 | 17.2 |
| 1.6 | 7.9 | 7.5 | 41.5 |
| 1.8 | 11.6 | 15.6 | 60.8 |
| 2.0 | 17.7 | 41.2 | 87.2 |
| 2.2 | 30.2 | 77.4 | 206.1 |
| 2.4 | 54.5 | 150.7 | 826.0 |
| 2.6 | 94.9 | 278.5 | 1307.3 |
| 2.8 | 155.3 | 367.9 | — |
| 3.0 | 239.7 | 488.5 | — |

TABLE VII

| Relative Log Input Exposure | Standard Deviation | | |
|---|---|---|---|
| | Invention Fil #2 | Comparison Fil #3 | Comparison Fil #4 |
| 0.0 | 2.2 | 2.2 | 2.7 |
| 0.2 | 1.6 | 1.7 | 2.3 |
| 0.4 | 1.4 | 1.4 | 1.9 |
| 0.6 | 1.3 | 1.4 | 1.6 |
| 0.8 | 1.7 | 1.7 | 1.9 |
| 1.0 | 2.3 | 2.2 | 2.8 |
| 1.2 | 2.9 | 3.2 | 3.9 |
| 1.4 | 3.7 | 5.2 | 4.9 |
| 1.6 | 5.4 | 7.5 | 7.1 |
| 1.8 | 9.2 | 14.3 | 11.2 |
| 2.0 | 16.0 | 25.5 | 20.6 |
| 2.2 | 27.9 | 49.2 | 37.6 |
| 2.4 | 51.2 | 115.3 | 71.8 |
| 2.6 | 89.6 | 113.6 | 121.7 |
| 2.8 | 139.7 | 233.7 | 216.3 |
| 3.0 | 215.2 | 355.6 | 323.9 |

The lower the standard deviation, the higher the signal to noise ratio in the photographic element. As is apparent from Table VII the standard deviation of Invention Film #2 is at least comparable to and in most instances significantly lower than that reported for either of the comparison films.

The invention has been described in detail with particular reference to preferred embodiments thereof, but it will be understood that variations and modifications can be effected within the spirit and scope of the invention.

What is claimed is:

1. A photographic element comprised of a support and at least two silver halide emulsion layers differing in threshold sensitivities for recording exposures within the same region of the spectrum, wherein said silver halide emulsion layers differing in threshold sensitivities (1) each record exposures within only one of the blue, green or red regions of the spectrum, (2) are each orthochromatically sensitized to record exposures in the blue and green portions of the spectrum, or (3) are each panchromatically sensitized to record exposures in the blue, green and red portions of the spectrum, one of said emulsion layers is capable of recording an image that exhibits a higher signal to noise ratio than at least one other of said emulsion layers in at least one exposure range above their threshold sensitivities, and at least two of the emulsion layers differing in threshold sensitivities each contain a different dye image providing material capable of providing a different image dye after processing, each of said different dye image providing materials being chosen so that when any two of the image dyes produced by said different dye image providing materials are compared, at least 25 percent of the half peak absorption band width of each image dye lies in a spectral region unoccupied by the half peak absorption band width of the compared image dye.

2. A photographic element according to claim 1 wherein the emulsion layers for recording within the same region of the spectrum have threshold sensitivities that differ by at least 0.15 log E, where E represents exposure in lux-seconds.

3. A photographic element according to claim 2 wherein the emulsion layers for recording within the same region of the spectrum have threshold sensitivities that differ by up to 2.0 log E, where E represents exposure in lux-seconds.

4. A photographic element according to claim 1 wherein each of said dye image providing materials are chosen so that when any two of the image dyes produced by said different dye image providing materials are compared, at least 50 percent of the half peak absorption band width of each image dye lies in a spectral region unoccupied by the half peak absorption band width of the compared image dye.

5. A photographic element according to claim 4 wherein the dye image providing materials each produce an image dye exhibiting a half peak absorption band width which lies in a spectral region unoccupied by the half peak absorption band width of any other image dye present after processing.

6. A photographic element according to claim 1 wherein the one of said emulsion layers requiring the least exposure to reach its threshold sensitivity also exhibits the shortest exposure latitude of said emulsion layers for recording exposures in the same region of the spectrum.

7. A photographic element according to claim 1 wherein the one of said emulsion layers requiring the least exposure to reach its threshold sensitivity also contains less silver than any other of said emulsion layers for recording exposures in the same region of the spectrum.

8. A photographic element according to claim 7 wherein the one of said emulsion layers requiring the least exposure to reach its threshold sensitivity contains from 5 to 20 percent of the total silver contained in said emulsion layers for recording exposures in the same region of the spectrum.

9. A photographic element according to claim 1 wherein, of said emulsion layers intended to record exposures within the same region of the spectrum, the emulsion layer requiring the least exposure to reach its threshold sensitivity is coated farthest from the support to receive exposing radiation prior to all other of said emulsion layers intended to record exposures within the same region of the spectrum.

10. A photographic element according to claim 1 wherein, of said emulsion layers intended to record exposures within the same region of the spectrum, the emulsion layer requiring the least exposure to reach its threshold sensitivity is coated nearest the support to receive exposing radiation after all other of said emulsion layers intended to record exposures within the same region of the spectrum.

11. A photographic element according to claim 1 wherein said emulsion layers intended to record exposures within the same region of the spectrum include at least three emulsion layers and, of the emulsion layers intended to record exposures within the same region of the spectrum, the emulsion layer exhibiting an intermediate threshold sensitivity is coated farthest from the support to receive exposing radiation prior to all other of said emulsion layers intended to record exposures within the same region of the spectrum.

12. A photographic element according to claim 1, wherein each of said emulsion layers for recording within the same region of the spectrum contain at least 75 percent of the dye image providing material required to react with all oxidized developing agent formed by maximum silver halide development during processing.

13. A photographic element according to claim 12, wherein each of the emulsion layers for recording within the same region of the spectrum contain at least 100 percent of the dye image providing material required to react with all oxidized developing agent formed by maximum silver halide development during processing.

14. A photographic element comprised of a transparent film support and at least three silver halide emulsion layers for recording exposures within the same region of the spectrum, each containing a dye-forming coupler and each exhibiting differing threshold sensitivities for recording exposures within the same region of the spectrum, wherein, a first of said emulsion layers is coated nearest the support, a second of said emulsion layers is coated to overlie said first emulsion layer, requires from 0.15 log E to 1.00 log E, where E represents exposure in lux-seconds, less exposure to reach its threshold sensitivity than said first emulsion layer, a third of the three emulsion layers is coated farthest from the support of the three emulsion layers, exhibits a threshold sensitivity that requires from 0.15 log E to 1.00 log E less exposure to reach its threshold sensitivity than said second emulsion layer, and each of said dye-forming couplers being chosen so that when any two of the image dyes produced by said dye-forming couplers are compared, at least 25 percent of the half peak absorption band width of each image dye lies in a spectral region unoccupied by the half peak absorption band width of the compared image dye.

15. A photographic element comprised of a transparent film support and three silver halide emulsion layers for recording exposures within the same region of the spectrum, each containing a dye-forming coupler and each exhibiting differing threshold sensitivities for recording exposures within the same region of the spectrum, wherein, said three emulsion layers exhibit threshold sensitivities that differ by from 0.15 log E to 1.00 log E, where E represents exposure in lux-seconds, a first of said three emulsion layers containing a dye-forming coupler is coated nearest the support, a second of said three emulsion layers is coated to overlie said first emulsion layer, and a third of said three emulsion layers is coated farthest from the support of said three emulsion layers and exhibits a threshold sensitivity that lies at an intermediate exposure level as compared to the threshold sensitivities of the first and second three emulsion layers, and each of said dye-forming couplers being chosen so that when any two of the image dyes produced by said dye-forming couplers are compared, at least 50 percent of the half peak absorption band width of each image dye lies in a spectral region unoccupied by the half peak absorption band width of the compared image dye.

16. A photographic element according to claim 14 or 15, wherein a development inhibitor releasing coupler is contained in the photographic element.

17. A photographic element according to claim 14 or 15, wherein said emulsion layers for recording within the same region of the spectrum are separated by interlayers each containing an oxidized developing agent scavenger.

18. A photographic element comprised of a transparent film support and at least two silver halide emulsion layers differing in threshold sensitivities for recording exposures within the same region of the spectrum, wherein each of said emulsion layers is panchromatically sensitized, at least two of said emulsion layers each contains a different dye-forming coupler for producing a dye image upon imagewise exposure and processing, each of said dye-forming couplers being chosen so that when any two of the image dyes produced by said dye-forming couplers are compared, at least 25 percent of the half peak absorption band width of each image dye lies in a spectral region unoccupied by the half peak absorption band width of the compared image dye, said dye-forming coupler in each emulsion layer being present in an amount sufficient to react with all of the oxidized developing agent produced by maximum silver halide development during processing, and one of said emulsion layers requiring a higher exposure to reach its threshold sensitivity than at least one other of said emulsion layers is capable of producing a dye image exhibiting a higher signal to noise ratio than said at least one other of said emulsion layers in at least one exposure range above its threshold sensitivity.

19. A photographic element according to claim 18, wherein the different dye-forming couplers in said emulsion layers are chosen to form dye images of a different subtractive primary hue.

20. A photographic element comprised of a transparent film support and at least three image recording layer units each intended to record an imagewise exposure within a different one of the blue, green and red portions of the spectrum, wherein at least one of the image recording layer units contains two or more silver halide emulsion layers having differing threshold sensitivities, a first of said emulsion layers requiring less exposure to reach its threshold sensitivity than at least a second of said emulsion layers is capable of recording an image that exhibits a higher signal to noise ratio than that of said second emulsion layer in at least one exposure range above their threshold sensitivities, and each of said emulsion layers contains a different dye-forming coupler, each of said dye-forming couplers being chosen so that when any two of the image dyes produced by said dye-forming couplers are compared, at least 25 percent of the half peak absorption band width of each image dye lies in a spectral region unoccupied by the half peak absorption band width of the compared image dye.

21. A process of producing a viewable photographic image comprising photographically processing an imagewise exposed photographic element containing at least two silver halide emulsion layers capable of recording within the same region of the spectrum and having differing threshold sensitivities to produce a photographic image and employing the photographic image to produce a viewable image, wherein different dye images are produced during processing following imagewise exposure in said emulsion layers, each dye image when compared to any other dye image has a half peak absorption band width at least 25 percent of which lies in a spectral region unoccupied by the half peak absorption band width of the compared dye image, a first of said two emulsion layers requiring a higher exposure to reach its threshold sensitivity exhibiting a higher signal to noise ratio dye image in at least one exposure range above its threshold sensitivity after processing than a second of said two emulsion layers, and the dye image of said first emulsion layer is preferentially employed in producing portions of the viewable image indicative of exposures above its threshold sensitivity within an exposure range in which it exhibits a higher signal to noise ratio.

22. A process according to claim 21, wherein the exposure records of all of said emulsion layers exposed to a level exceeding their threshold sensitivities are employed to produce a combined viewable image exhibiting a lower standard deviation than that of any one of the images produced by the individual emulsion layers.

23. A process according to claim 21, wherein said first emulsion layer is positioned to receive imagewise exposing radiation prior to any other emulsion layer capable of recording within the same region of the spectrum and the image record formed by the first emulsion layer within at least one exposure range exceeding its threshold sensitivity is employed alone in producing a viewable image corresponding to that exposure range, thereby allowing a viewable image of increased sharpness to be formed.

24. A process according to claim 21, wherein a dye image is produced in each of the emulsion layers capable of recording within the same region of the spectrum during photographic processing, each dye image having a half peak absorption band width at least 50 percent of which lies in a spectral region unoccupied by the half peak absorption band width of any other image dye present after processing,

25. A process according to claim 24, wherein the half peak absorption bands of the dye images each occupy a different wavelength portion of the spectrum.

26. A process according to claim 25, wherein each of the dye images is produced by the reaction of a dye-forming coupler with an oxidized developing agent.

27. A process according to claim 26, wherein the dye-forming coupler in each emulsion layer capable of recording in the same region of the spectrum is present in a concentration sufficient to react with at least 75 percent of the oxidized developing agent produced by maximum silver halide development.

28. A process according to claim 27, wherein the dye-forming coupler in each emulsion layer capable of recording in the same region of the spectrum is present in a concentration sufficient to react with at least 100 percent of the oxidized developing agent produced by maximum silver halide development.

29. A process according to claim 21, wherein silver halide development in the emulsion layer requiring the least exposure to reach its threshold sensitivity is restricted in image regions receiving imagewise exposures above the threshold sensitivities of each of the emulsion layers capable of recording within the same spectral region.

30. A process according to claim 21 wherein the silver halide emulsion layers differing in threshold sensitivities (1) each record exposures within only one of the blue, green or red regions of the spectrum, (2) are each orthochromatically sensitized to record exposures in the blue and green portions of the spectrum, or (3) are each panchromatically sensitized to record exposures in the blue, green and red portions of the spectrum.

* * * * *